US008613489B2

(12) United States Patent
Tsukamoto et al.

(10) Patent No.: US 8,613,489 B2
(45) Date of Patent: Dec. 24, 2013

(54) INKJET EJECTION APPARATUS, INKJET EJECTION METHOD, AND INKJET RECORDING APPARATUS

(75) Inventors: Ryuji Tsukamoto, Kanagawa-ken (JP); Kenichi Kodama, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 224 days.

(21) Appl. No.: 13/006,922

(22) Filed: Jan. 14, 2011

(65) Prior Publication Data

US 2011/0175956 A1 Jul. 21, 2011

(30) Foreign Application Priority Data

Jan. 18, 2010 (JP) ..... 2010-008375

(51) Int. Cl.
*B41J 29/38* (2006.01)

(52) U.S. Cl.
USPC ..... 347/10; 347/11

(58) Field of Classification Search
USPC ..... 347/10
See application file for complete search history.

(56) References Cited

U.S. PATENT DOCUMENTS 6,494,555 B1 12/2002 Ishikawa
2007/0046704 A1* 3/2007 Okuda ..... 347/11

FOREIGN PATENT DOCUMENTS

JP 11-348320 A 12/1999

* cited by examiner

*Primary Examiner* — Uyen-Chau N Le
*Assistant Examiner* — Kajli Prince
(74) *Attorney, Agent, or Firm* — Birch, Stewart, Kolasch & Birch, LLP

(57) ABSTRACT

A standard drive waveform contains, in one ejection cycle: a first ejection waveform group including at least one ejection waveform causing liquid to be ejected from a nozzle to form one dot of a maximum size; a first non-ejection waveform arranged after the first ejection waveform group; a second ejection waveform group including at least one ejection waveform causing the liquid to be ejected from the nozzle to form a dot of a minimum size; and a second non-ejection waveform arranged after the second ejection waveform group. At least one of the ejection waveforms is selected from one of the first and second ejection waveform groups in accordance with ejection data. When the selected ejection waveform belongs to the first ejection waveform group, the first non-ejection waveform is further selected. When the selected ejection waveform belongs to the second ejection waveform group, the second non-ejection waveform is further selected.

18 Claims, 17 Drawing Sheets

INKJET EJECTION APPARATUS, INKJET EJECTION METHOD, AND INKJET RECORDING APPARATUS

BACKGROUND OF THE INVENTION

1. Field of the Invention

The present invention relates to an inkjet ejection apparatus, an inkjet ejection method and an inkjet recording apparatus, and more particularly to inkjet ejection technology for forming dots of a plurality of sizes.

2. Description of the Related Art

In an inkjet recording apparatus forming a desired image on a recording medium by using an inkjet method, a drive method is known which, in order to form dots of a plurality of sizes, operates a drive element, such as a piezoelectric element, by selecting one or more drive waveforms corresponding to a desired dot size from common drive waveforms having waveforms corresponding to a plurality of dot sizes.

Japanese Patent Application Publication No. 11-348320 discloses an inkjet ejection apparatus including: a generating device which outputs a reference signal in which ejection pulses for performing one ejection action are joined together a maximum number of times at prescribed time intervals and which also includes a non-ejecting pulse to drive an actuator so as to cancel out pressure wave vibration inside an ink chamber after an interval that enables the pressure wave vibration inside the ink chamber to be substantially cancelled out, from the last ejection pulse of the maximum number of times; and a correction device which outputs an application drive signal for application to an actuator by removing an unwanted portion of the reference signal in accordance with a number of ejection actions specified in respect of the print data for one dot, wherein the application drive signal is output by removing a prescribed number of ejection pulses which constitute the reference signal, sequentially from the start.

However, the swelling of the meniscus after ejecting a prescribed number of droplets differs between a case where a dot (a dot of minimum size) is formed by ejection in which a single pulse is applied, and a case where a dot (a dot of maximum size, for example) is formed by ejection in which a plurality of pulses are consecutively applied. For example, the swelling of the meniscus after ejection when five pulses have been consecutively applied is clearly greater than when a single pulse has been applied. Since the meniscus after ejection when a single pulse has been applied rarely shows large oscillation sufficient to affect the next ejection operation, then application of a non-ejection pulse to cancel out pressure wave vibration inside the ink chamber is not necessary. On the other hand, a satellite droplet is liable to occur after ejection by application of a single pulse and there is a risk that the shape of the droplet (and the resulting dot) may deform due to the occurrence of satellite.

More specifically, in the ejection technology disclosed in Japanese Patent Application Publication No. 11-348320, the state of swelling of the meniscus varies with the number of pulses having been applied, but since the same non-ejection pulse is used for any number of pulses, the technology cannot be considered to respond sufficiently to all states of swelling of the meniscus. Moreover, when a single pulse is applied or a small number of pulses are consecutively applied, there is a risk of deterioration of the dot shape due to the occurrence of satellite, and therefore a countermeasure of some kind is necessary in order to suppress the occurrence of satellite.

SUMMARY OF THE INVENTION

The present invention has been contrived in view of these circumstances, an object thereof being to provide an inkjet ejection apparatus, an inkjet ejection method and an inkjet recording apparatus, whereby a stable ejection operation can be achieved in respect of any dot size, in a driving method which uses a drive signal having waveform elements selected in accordance with a desired dot size, from a plurality of waveform elements.

In order to attain the aforementioned object, the present invention is directed to an inkjet ejection apparatus comprising: an inkjet head which includes: a nozzle through which droplets of liquid are ejected to a recording medium; a liquid chamber which contains the liquid and is connected to the nozzle; and a piezoelectric actuator which applies pressure to the liquid in the liquid chamber when a drive signal is applied to the piezoelectric actuator; and a drive device which drives the inkjet head by supplying the drive signal so as to eject droplets of the liquid to selectively form dots of at least two different sizes on the recording medium, wherein the drive device includes: a waveform generating device which generates a standard drive waveform, the standard drive waveform containing, in one ejection cycle: a first ejection waveform group which includes one or more of ejection waveforms capable of causing the liquid to be ejected from the nozzle to form one dot of a maximum size on the recording medium; a first non-ejection waveform which is arranged after the first ejection waveform group by a first time interval from a start of a last one of the one or more of ejection waveforms of the first ejection waveform group until a start of the first non-ejection waveform, the first non-ejection waveform not causing the liquid to be ejected from the nozzle, the first non-ejection waveform being applied in order to suppress meniscus vibration after ejection; a second ejection waveform group which includes one or more of ejection waveforms capable of causing the liquid to be ejected from the nozzle to form at least a dot of a minimum size on the recording medium; and a second non-ejection waveform which is arranged after the second ejection waveform group by a second time interval from a start of a last one of the one or more of ejection waveforms of the second ejection waveform group until a start of the to second non-ejection waveform, the second non-ejection waveform not causing the liquid to be ejected from the nozzle, the second non-ejection waveform being applied in order to suppress an occurrence of satellite after ejection; a waveform selecting device which selects at least one of the ejection waveforms from one of the first and second ejection waveform groups in accordance with ejection data, the waveform selecting device further selecting the first non-ejection waveform when the selected at least one of the ejection waveforms belongs to the first ejection waveform group, the waveform selecting device further selecting the second non-ejection waveform when the selected at least one of the ejection waveforms belongs to the second ejection waveform group; and a drive signal generating device which generates the drive signal having the selected at least one of the ejection waveforms and the selected one of the first and second non-ejection waveforms.

According to this aspect of the present invention, when driving the inkjet head so as to selectively form dots of at least two different sizes, either meniscus stabilization after ejection or suppression of the occurrence of satellite after ejection is selectively performed by selecting either a combination of the first ejection waveform group and the first non-ejection waveform, or a combination of the second ejection waveform group and the second non-ejection waveform, in accordance with the ejection data, from the standard drive waveform which includes the first ejection waveform group containing the at least one ejection waveform capable of forming a dot of the maximum size, the first non-ejection waveform for suppressing meniscus vibration after ejection, the second ejection waveform group containing the at least one ejection waveform capable of forming at least a dot of the minimum size, and the second non-ejection waveform for suppressing the occurrence of satellite after ejection. Therefore, desirable droplet ejection is performed in which either the occurrence of satellite is suppressed or vibration of the meniscus is suppressed, in accordance with the ejection conditions.

Furthermore, since the drive method is employed in which the waveform elements required for droplet ejection are extracted from the standard elements included in the standard drive waveform, and the unwanted waveform elements are removed, then it is possible to achieve a smaller-scale composition of the drive device.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Description of Inkjet Ejection Apparatus

Figure 1:
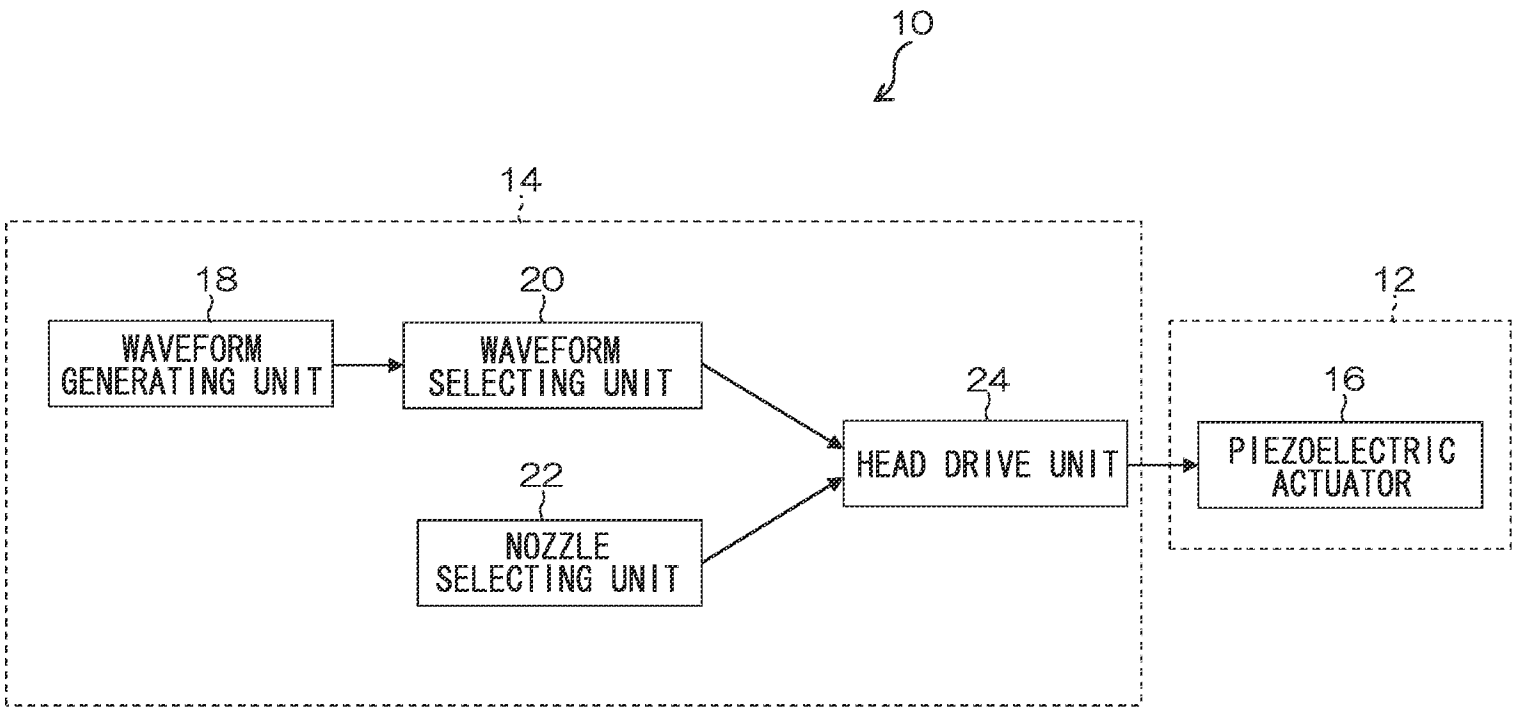
FIG. 1 is a block diagram of an inkjet ejection apparatus according to an embodiment of the present invention.

FIG. 1 is a block diagram of an inkjet ejection apparatus according to an embodiment of the present invention. The inkjet ejection apparatus 10 in the present embodiment includes an inkjet head 12, which ejects liquid in the form of droplets (liquid droplets) by means of an inkjet method, and a drive device 14, which supplies a prescribed drive signal to the inkjet head 12 to operate the inkjet head 12.

The inkjet head 12 employs a piezoelectric method in which piezoelectric actuators 16 forming pressure sources for ejecting droplets are provided and liquid droplets are ejected by operating the piezoelectric actuators 16 in accordance with drive signals supplied from the drive device 14. As described in detail below (see FIG. 2), the inkjet head 12 has a composition including: nozzles serving as ejection ports for liquid droplets; pressure chambers, connected to the nozzles, which are pressurized by the piezoelectric actuators 16; and liquid flow channels connected to the pressure chambers, and the like.

The drive device 14 includes: a waveform generating unit 18, which generates a standard drive waveform constituted of a plurality of waveform elements; a waveform selecting unit 20, which generates a waveform selection signal for selecting one or more of waveform elements corresponding to a dot size from the standard drive waveform; a nozzle selecting unit 22, which generates a nozzle selection signal for selecting a nozzle from which a droplet is ejected on the basis of ejection data; and a head drive unit 24, which generates a drive signal on the basis of a drive waveform constituted of the waveform element(s) selected by the waveform selecting unit 20 and which supplies the drive signal to the piezoelectric actuator 16 corresponding to the nozzle selected by the nozzle selecting unit 22.

The inkjet ejection apparatus 10 in the present embodiment is composed so as to be able to eject droplets corresponding to three dot sizes, namely, a large size, a medium size and a small size. More specifically, when forming a dot of the large size, a drive waveform for ejecting a large droplet corresponding to the large size dot is selected, when forming a dot of the medium size, a drive waveform for ejecting a medium droplet corresponding to the medium size dot is selected, and when forming a dot of the small size, a drive waveform for ejecting a small droplet corresponding to the small size dot is selected.

The inkjet ejection apparatus 10 in the present embodiment employs a method in which a common drive signal is supplied to the piezoelectric actuators 16 arranged correspondingly to the nozzles, one of the nozzles from which ejection is to be performed is selected by a nozzle selection signal output from the nozzle selecting unit 22, and a drive signal is applied only to the piezoelectric actuator 16 corresponding to the nozzle selected by the nozzle selection signal.

The inkjet head 12 and the drive device 14 can be composed separately and connected through a wiring member such as a flexible circuit, or the like, or the inkjet head 12 and the drive device 14 can be integrally composed.

<Composition of Inkjet Head>

Next, an embodiment of the structure of the inkjet head 12 shown in FIG. 1 is described.

Figure 2:
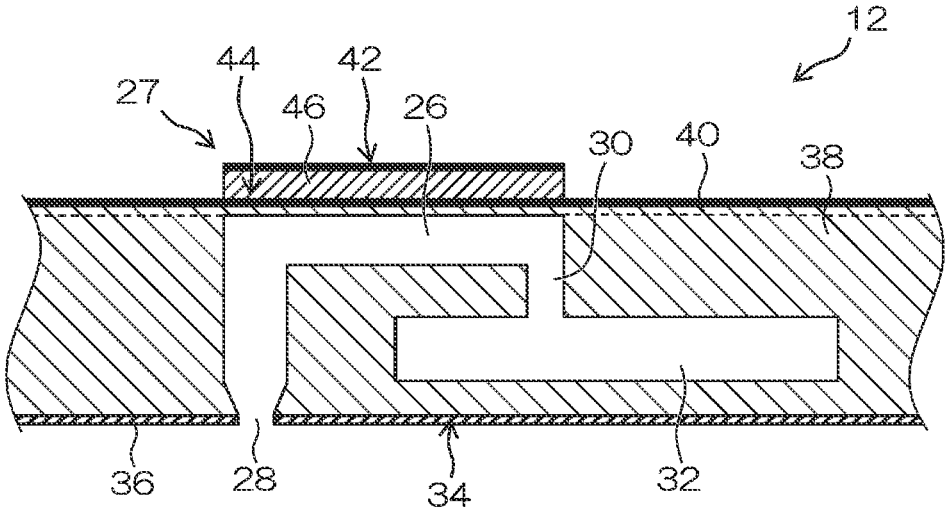
FIG. 2 is a cross-sectional diagram showing an embodiment of the structure of the inkjet head shown in FIG. 1.

FIG. 2 is a cross-sectional diagram showing an embodiment of the inner structure of the inkjet head 12, and depicts a droplet ejection element corresponding to one channel, which is a unit recording element. The inkjet head 12 shown in FIG. 2 is composed so as to eject droplets of liquid from a nozzle 28 connected to a pressure chamber 26 by applying pressure to the liquid inside the pressure chamber 26 through operating a piezoelectric element 27 which is arranged on the ceiling surface of the pressure chamber 26. When droplets are ejected from the nozzle 28, the liquid is filled into the pressure chamber 26 through a supply port 30 connected to the pressure chamber 26 and a common flow channel 32 from a tank (not shown) serving as a liquid supply source.

The inkjet head 12 shown in FIG. 2 has a structure in which a nozzle plate 36 having nozzles 28 formed in a nozzle surface 34, and a flow channel plate 38 in which flow channels such as the pressure chambers 26, the supply ports 30 and the common flow channel 32 and the like are formed, are stacked and bonded to each other. The nozzle plate 36 forms the nozzle surface 34 of the inkjet head 12. The nozzles 28, which are respectively connected to the pressure chambers 26, are arranged in a prescribed arrangement pattern in the nozzle plate 36.

The flow channel plate 38 is a flow channel forming member, which constitutes side walls of the pressure chamber 26 and in which the supply port 30 is formed to serve as a restricting section (the narrowest portion) of an individual supply channel for conducting ink to each pressure chamber 26 from the common flow channel 32. For the sake of the description, a simplified view is given in FIG. 2, but the flow channel plate 38 has a structure formed of a single substrate or a plurality of substrates stacked together. The nozzle plate 36 and the flow channel plate 38 can be made of silicon and processed into a desired shape by a semiconductor manufacturing process.

The piezoelectric element 27 is bonded on a diaphragm 40, which constitutes a portion of the surface (the ceiling face in FIG. 2) of the pressure chamber 26. The piezoelectric element 27 has an upper electrode (individual electrode) 42 and a lower electrode 44, which is arranged on the diaphragm 40, and a piezoelectric body 46, which is placed between the upper electrode 42 and the lower electrode 44. In a case where the diaphragm 40 is constituted of a thin film of a metal or a metal oxide, the diaphragm 40 can also function as a common electrode, which corresponds to the lower electrode 44 of the piezoelectric element 27. In a case where the diaphragm 40 is constituted of a non-conductive material, such as resin, a lower electrode layer made of a conductive material, such as metal, is formed on the surface of the diaphragm material.

When a drive voltage is applied to the upper electrode 42, the piezoelectric element 27 deforms and the diaphragm 40 also deforms, thus changing the volume of the pressure chamber 26, and a liquid droplet is ejected from the nozzle 28 due to the resulting pressure change. The piezoelectric actuator 16 shown in FIG. 1 has a composition which includes the piezoelectric element 27 and the diaphragm 40 shown in FIG. 2, and forms a pressure generating source for generating a liquid ejection pressure in accordance with a drive signal. The piezoelectric actuator 16 shown in FIG. 1 can adopt a mode in which the diaphragm 40 shown in FIG. 2 is omitted (for example, a bimorph structure in which two piezoelectric elements are layered together).

Description of Drive Signal

First Embodiment

Figure 3A:
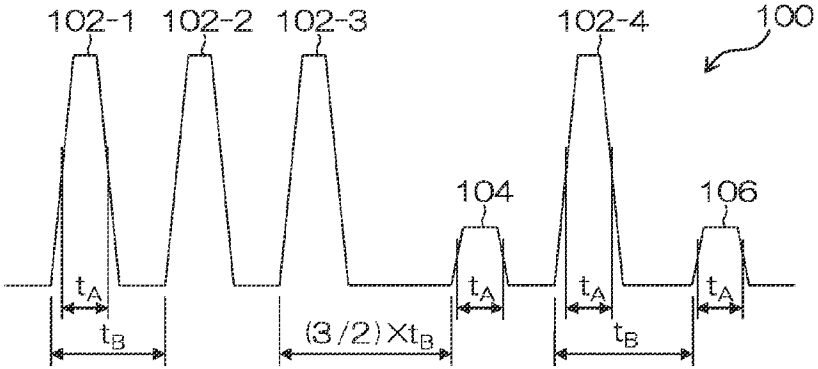
FIGS. 3A to 3C are diagrams for describing a drive waveform for ejection of a small droplet according to the first embodiment of the present invention.

Next, the drive signal according to a first embodiment of the present invention is described. FIG. 3A is a diagram showing a schematic view of a standard drive waveform 100 corresponding to one ejection cycle, in which the horizontal axis represents time and the vertical axis represents voltage (amplitude). The rising portion of the drive signal in the present embodiment causes the piezoelectric element to operate so as to pull the meniscus of the liquid inside the nozzle (pull operation), and the falling portion of the drive signal causes the piezoelectric element to operate so as to push the meniscus of the liquid outside the nozzle (push operation).

The standard drive waveform 100 shown in FIG. 3A has a number of ejection waveforms (in this case, four waveforms 102-1 to 102-4, hereinafter also referred to generally as "waveforms 102"), which is greater than the maximum number of ejection actions for forming one dot (in this embodiment, three actions), and also has two types of non-ejection waveforms 104 and 106. The non-ejection waveform 104 is arranged between the ejection waveform 102-3 and the ejection waveform 102-4, and the non-ejection waveform 106 is arranged after the ejection waveform 102-4. More specifically, there are three ejection waveforms 102-1, 102-2 and 102-3, which are consecutive at prescribed time intervals apart, and the non-ejection waveform (meniscus stabilizing waveform) 104 for stabilizing the meniscus is arranged after the third ejection waveform 102-3. Here, a group constituted of the three ejection waveforms 102-1 to 102-3 is taken as a first ejection waveform group.

There is also the ejection waveform 102-4 after the meniscus stabilizing waveform 104, and the non-ejection waveform (satellite suppressing waveform) 106 for suppressing the occurrence of satellite is arranged after the ejection waveform 102-4. The ejection waveform 102-4 is taken as a second ejection waveform group, in comparison with the first ejection waveform group.

An "ejection waveform" is a waveform capable of operating the piezoelectric element 27 (see FIG. 2) so as to eject a liquid droplet of a prescribed volume from the nozzle in the normal state, and a "non-ejection waveform" is a waveform capable of operating the piezoelectric element 27 so as to apply pressure to the meniscus in the nozzle 28 (see FIG. 2) without causing any droplets to be ejected from the nozzle in the normal state.

The ejection waveforms 102 in FIG. 3A have the same trapezoid shape, and one ejection waveform 102 corresponds to a minimum ejection volume of droplet. The shape of the ejection waveforms 102 is not limited to the same shape, and parameters such as the amplitude (voltage), pulse width, gradient (rise time and/or fall time), and the like, can be changed as appropriate, provided that the waveform has a surface area corresponding to the minimum ejection volume. The time period $t_B$ from the center of the rising portion of the ejection waveform 102 until the center of the falling portion of same is the pulse width of the ejection waveform 102, and the time period $t_B$ from the start of a particular ejection waveform 102 until the start of the next ejection waveform 102 is the ejection waveform interval.

The time from the start of the last ejection waveform 102-3 of the three consecutive ejection waveforms 102-1 to 102-3 until the start of the meniscus stabilizing waveform 104 is $3\times t_B/2$ or a positive-integer multiple of $3\times t_B/2$ (i.e., $3\times t_B\times n/2$, where n is a positive integer). The ejection waveform 102-4 arranged after the meniscus stabilizing waveform 104 has the same shape as the ejection waveforms 102-1 to 102-3 of the first ejection waveform group. Of course, it is also possible to vary the parameters, such as the amplitude (voltage), pulse width, gradient, or the like, of the independent ejection waveform 102-4, and the parameters of the ejection waveforms 102-1 to 102-3 of the first ejection waveform group.

Each of the ejection waveforms 102-1 to 102-4 corresponds to a minimum ejection volume (the ejection volume of the small droplet). A dot of the minimum size (the small size dot) is formed by a droplet having this minimum ejection volume. When droplets are ejected by two or three consecutive ejection waveforms, these ejected droplets combine together and become a single droplet, which forms a single dot. The droplet volume created by the combination of droplets produced by two consecutive ejection actions corresponds to the medium size dot, and the droplet volume created by the combination of droplets produced by three consecutive ejection actions corresponds to the large size dot.

The meniscus stabilizing waveform 104 is the non-ejection waveform, which does not cause ejection of droplets, and is applied in order to suppress swelling up of the meniscus (transient effects of pressure waves) after ejection when forming the medium size dot or the large size dot. The meniscus stabilizing waveform 104 has an amplitude (voltage) of ½ or less (and more desirably, ⅓ or less) of the amplitude of the ejection waveform 102, and the pulse width (the time from the center of the rising portion to the center of the falling portion) is $t_A$.

In the standard drive waveform 100 in the present embodiment, the time interval between the ejection waveform 102-3 and the meniscus stabilizing waveform 104 is an odd-numbered multiple of ½ of the Helmholtz period Tc determined by the structure of the inkjet head 12 (i.e., the time interval is $Tc\times(2n-1)/2$, where n is a positive integer), in such a manner that the meniscus stabilizing waveform 104 and the vibration of the meniscus are in opposite phases. In other words, vibration of the meniscus is suppressed by applying the meniscus stabilizing waveform 104 that is of opposite phase to the vibration of the meniscus after two or three consecutive ejection actions (namely, the meniscus stabilizing waveform 104 having a phase displaced by ½ a cycle with respect to the phase of the vibration).

The satellite suppressing waveform 106 is the non-ejection waveform, which does not cause ejection of droplets, and is applied after the ejection waveform 102-4 in order to suppress the occurrence of satellite, by cutting off the tail of the droplet after ejection when forming the small size dot. The satellite suppressing waveform 106 has an amplitude of ½ or less (and desirably, ⅓ or less) of the amplitude of the ejection waveform 102, and the pulse width (the time from the center of the rising portion until the center of the falling portion) of $t_A$. The time interval from the start of the ejection waveform 102-4 until the start of the satellite suppressing waveform 106 (the time interval between the ejection waveform 102-4 and the satellite suppressing waveform 106) is $t_B$.

The time interval between the ejection waveform 102-4 and the satellite suppressing waveform 106 is an integral multiple of the Helmholtz period Tc (i.e., the time interval is $Tc\times n$, where n is a positive integer). In other words, the occurrence of satellite after ejection is effectively suppressed by applying the satellite suppressing waveform 106 having the same phase as the meniscus vibration after one independent ejection action.

Figure 3B:
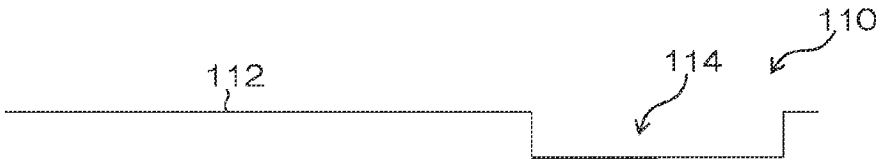
Figure 3C:
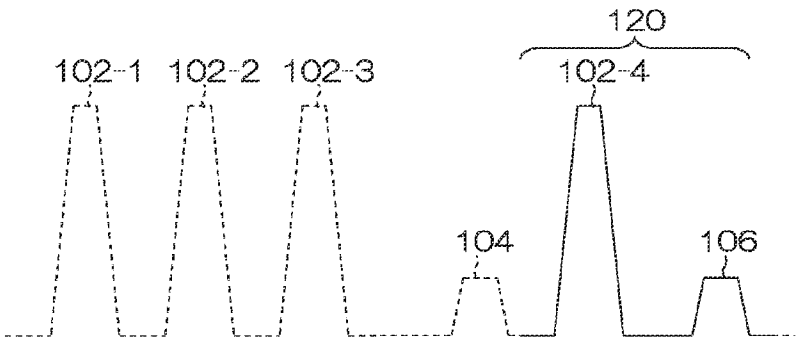

FIG. 3B shows a waveform selection signal 110 in a case of forming a small size dot. In FIG. 3B, the horizontal axis represents time and the vertical axis represents voltage. The waveform selection signal 110 is a negative logic pulse signal, in which the H level 112 means "do not select" and the L level 114 means "do select". Taking the logical sum of the waveform selection signal 110 shown in FIG. 3B and the standard drive waveform 100 shown in FIG. 3A, a group including the independent ejection waveform 102-4 and the satellite suppressing waveform 106 is selected, and the other waveform elements are removed. A drive waveform 120 illustrated with the solid lines in FIG. 3C, which is constituted of the ejection waveform 102-4 and the satellite suppressing waveform 106, is a drive waveform for forming the small size dot. The parts illustrated with the dotted lines in FIG. 3C represent the removed waveform elements.

Figure 4A:
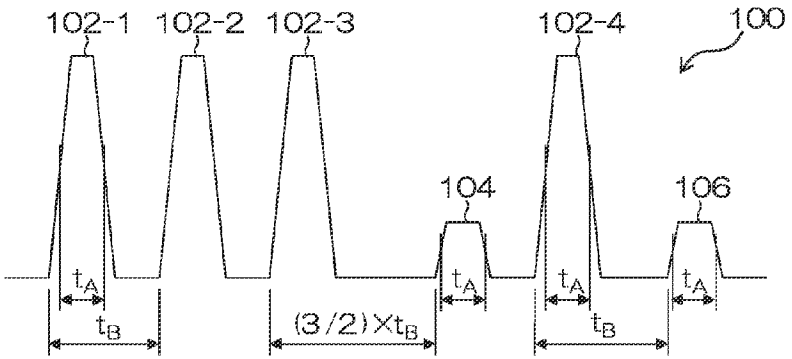
FIGS. 4A to 4C are diagrams for describing a drive waveform for ejection of a medium droplet according to the first embodiment of the present invention.
Figure 4B:
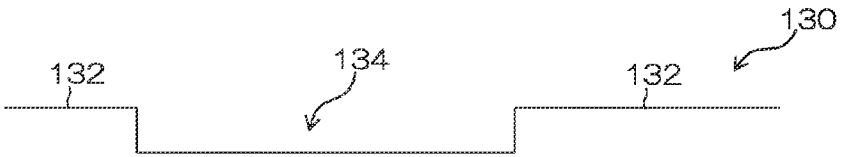
Figure 4C:
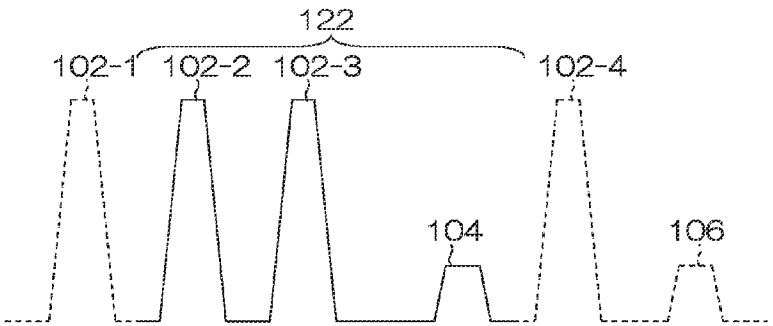

FIG. 4B shows a waveform selection signal 130 in a case of forming a medium size dot. The waveform selection signal 130 is a negative logic pulse signal having the H level 132 and the L level 134, similarly to the waveform selection signal 110 shown in FIG. 3B. Taking the logical sum of the waveform selection signal 130 shown in FIG. 4B and the standard drive waveform 100 shown in FIG. 4A (which is the same as the standard drive waveform 100 shown in FIG. 3A), a group including two ejection waveforms 102-2 and 102-3 and the meniscus stabilizing waveform 104 is selected, and the other waveform elements are removed. A drive waveform 122 illustrated with the solid lines in FIG. 4C, which is constituted of the ejection waveforms 102-2 and 102-3 and the meniscus stabilizing waveform 104, is a drive waveform for forming the medium size dot. The parts illustrated with the dotted lines in FIG. 4C represent the removed waveform elements.

Figure 5A:
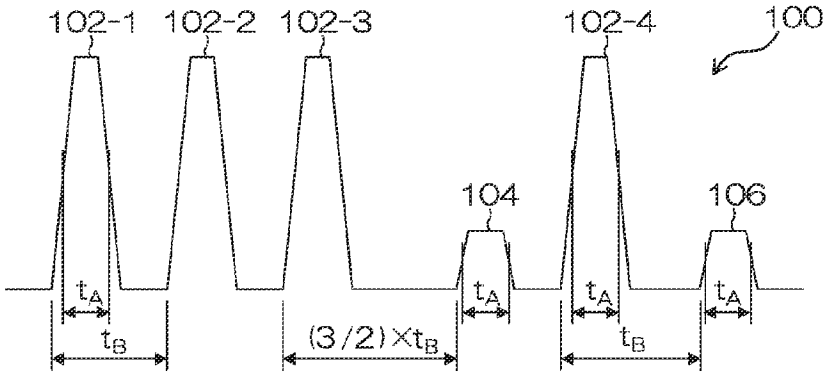
FIGS. 5A to 5C are diagrams for describing a drive waveform for ejection of a large droplet according to the first embodiment of the present invention.
Figure 5B:
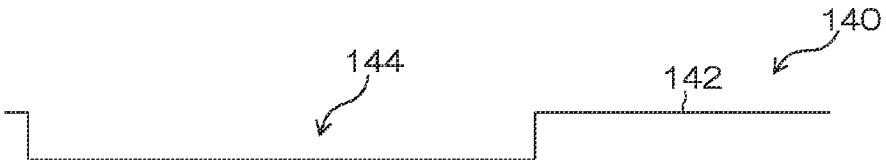
Figure 5C:
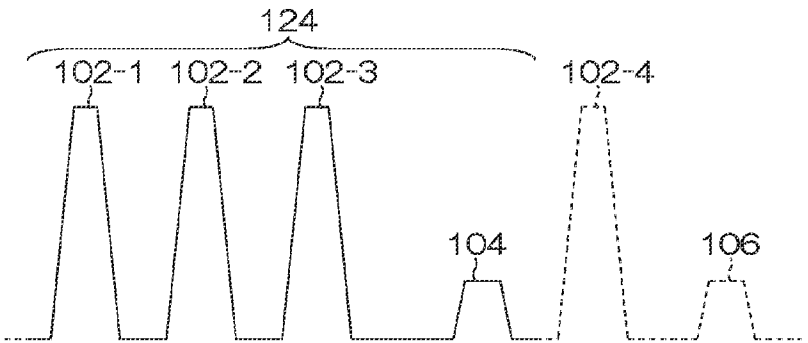

FIG. 5B shows a waveform selection signal 140 in a case of forming a large size dot. The waveform selection signal 140 is a negative logic pulse signal having the H level 142 and the L level 144. Taking the logical sum of the waveform selection signal 140 shown in FIG. 5B and the standard drive waveform 100 shown in FIG. 5A (which is the same as the standard drive waveform 100 shown in FIGS. 3A and 4A), a group including three ejection waveforms 102-1, 102-2 and 102-3 and the meniscus stabilizing waveform 104 is selected, and the other waveform elements are removed. A drive waveform 124 illustrated with the solid lines in FIG. 5C, which is constituted of the ejection waveforms 102-1, 102-2 and 102-3 and the meniscus stabilizing waveform 104, is a drive waveform for forming the large size dot. The parts illustrated with the dotted lines in FIG. 5C represent the removed waveform elements.

Here, one-pulse ejection for forming a small size dot is used principally in a high-precision ejection mode. The conditions required in terms of ejection characteristics in the high-precision ejection mode are that dots of clean shape (a circular shape with very little deformation) are obtained, without the occurrence of satellite after the ejection of the main droplet. On the other hand, in one-pulse ejection, there is little vibration of the meniscus after the ejection of the main droplet, compared to two-pulse ejection or three-pulse ejection, and hence there is considered to be little possibility that the effects of the vibration of the meniscus resulting from the previous ejection action cause problems such as deviation of flight of the ejected droplet or ejection abnormalities in the subsequent ejection.

Therefore, in the case of one-pulse ejection, by adding the satellite suppressing waveform 106 after the prescribed time interval ($t_B$) from the start of the ejection waveform 102-4, the occurrence of satellite after the ejection of the main droplet is effectively suppressed and a dot having a desirable shape can be obtained. Moreover, by making the time interval from the start of the ejection waveform 102-4 until the start of the satellite suppressing waveform 106 a positive integral multiple of the Helmholtz period Tc, the vibration of the meniscus after the ejection of the main droplet and the movement of the to meniscus caused by the satellite suppressing waveform 106 assume the same phase, and thus the occurrence of satellite can be suppressed more effectively.

Two-pulse consecutive ejection for forming a medium size dot and three-pulse consecutive ejection for forming a large size dot are used principally in low-precision ejection mode and high-speed ejection mode. An important condition required of the ejection characteristics in these ejection modes is that relatively large droplets can be reliably ejected without the occurrence of omissions in the nozzles. Two-pulse consecutive ejection and three-pulse consecutive ejection produce greater vibration of the meniscus after ejection of the main droplet, compared to the independent one-pulse ejection, and hence there is considered to be a high probability the effects of the vibration of the meniscus resulting from the previous ejection action cause problems such as deviation of flight of the ejected droplet or ejection abnormalities in the subsequent ejection.

Therefore, in the case of two-pulse consecutive ejection and three-pulse consecutive ejection, by adding the meniscus stabilizing waveform 104 after the prescribed time interval ($(3/2)\times t_B$) from the start of the last ejection waveform 102-3, vibration of the meniscus after the ejection of the last droplet of the consecutive ejection actions which contribute to the forming of one dot is suppressed, and the effects of meniscus vibration on droplet ejection for forming the next dot can be suppressed.

Moreover, by making the time interval from the start of the last ejection waveform 102-3 in the consecutive ejection actions which contribute to the forming of one dot until the start of the meniscus stabilizing waveform 104 an odd-numbered multiple of ½ of the Helmholtz period Tc, the vibration of the meniscus after the ejection of the last main droplet and the movement of the meniscus caused by the meniscus stabilizing waveform 104 assume the same phase, and thus the vibration of the meniscus can be rapidly constricted.

Figure 6A:
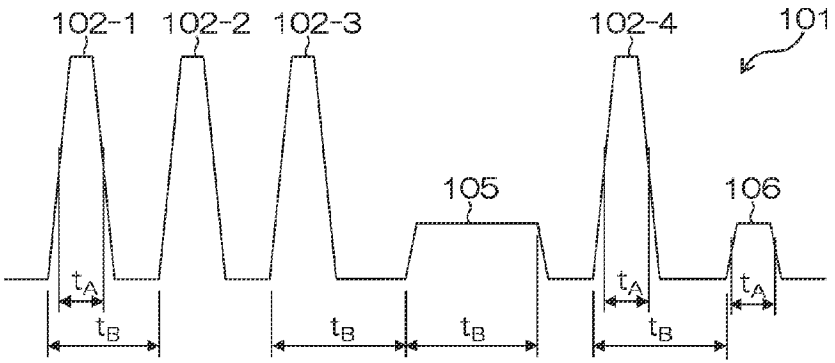
FIGS. 6A to 6C are diagrams for describing a further mode of the standard drive waveform shown in FIG. 5A.
Figure 6B:
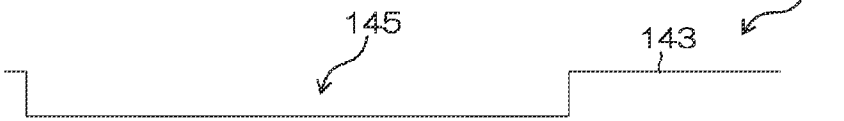
Figure 6C:
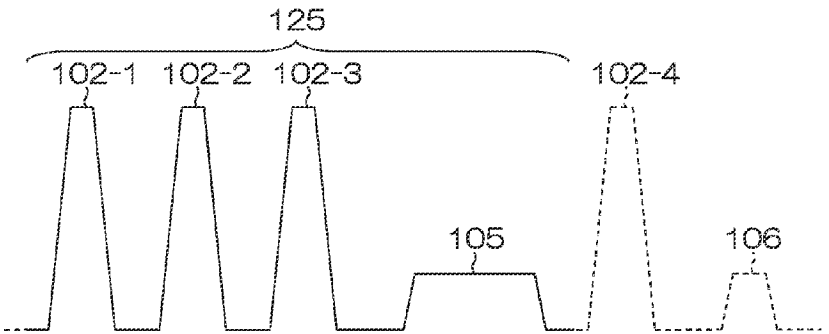

Furthermore, a desirable mode is one where, as in the standard drive waveform 101 shown in FIG. 6A, the time interval from the start of the last ejection waveform 102-3 until the start of a meniscus stabilizing waveform 105 is a positive-integer multiple of $t_B$, and the time interval from the start of the meniscus stabilizing waveform 105 until the start of falling of the meniscus stabilizing waveform 105 is a positive-integer multiple of $t_B$. In the drive waveform 125 (see FIG. 6C) determined by the logical sum of the standard drive waveform 101 and the waveform selection signal 141 having an H level 143 and an L level 145 as shown in FIG. 6B, the falling portion of the meniscus stabilizing waveform 105, which seeks to move the meniscus in the pushing direction, is in opposite phase to the meniscus, which is moved in the pulling direction by the transient effects (vibration) of the ejection caused by the ejection waveform 102-3, and therefore the vibration of the meniscus can be efficiently suppressed.

The end of the time interval from the start of the meniscus stabilizing waveform 105 can be any time within the range of the falling portion of the meniscus stabilizing waveform 105. Furthermore, the vibration of the meniscus can be suppressed by making the time interval from the start of the last ejection waveform 102-3 until the start of rising of the meniscus stabilizing waveform 105 an odd-numbered multiple of $t_B$, and thus making the phase of the movement of the meniscus opposite to the phase of the rising portion of the meniscus stabilizing waveform 105.

For example, in the ejection waveforms 102-1 to 102-4 shown in FIGS. 3A to 6A, the time $t_A$ is 5.0 μsec and the time $t_B$ is 10.3 μsec. The standard drive waveforms 100 and 101 shown in FIGS. 3A to 6A and the numerical values given above are simply examples, and the parameters such as the voltage (amplitude), pulse width, slew rate (rise time and fall time), and the like, can be appropriately changed, provided that the conditions stated above are satisfied.

Figure 7:
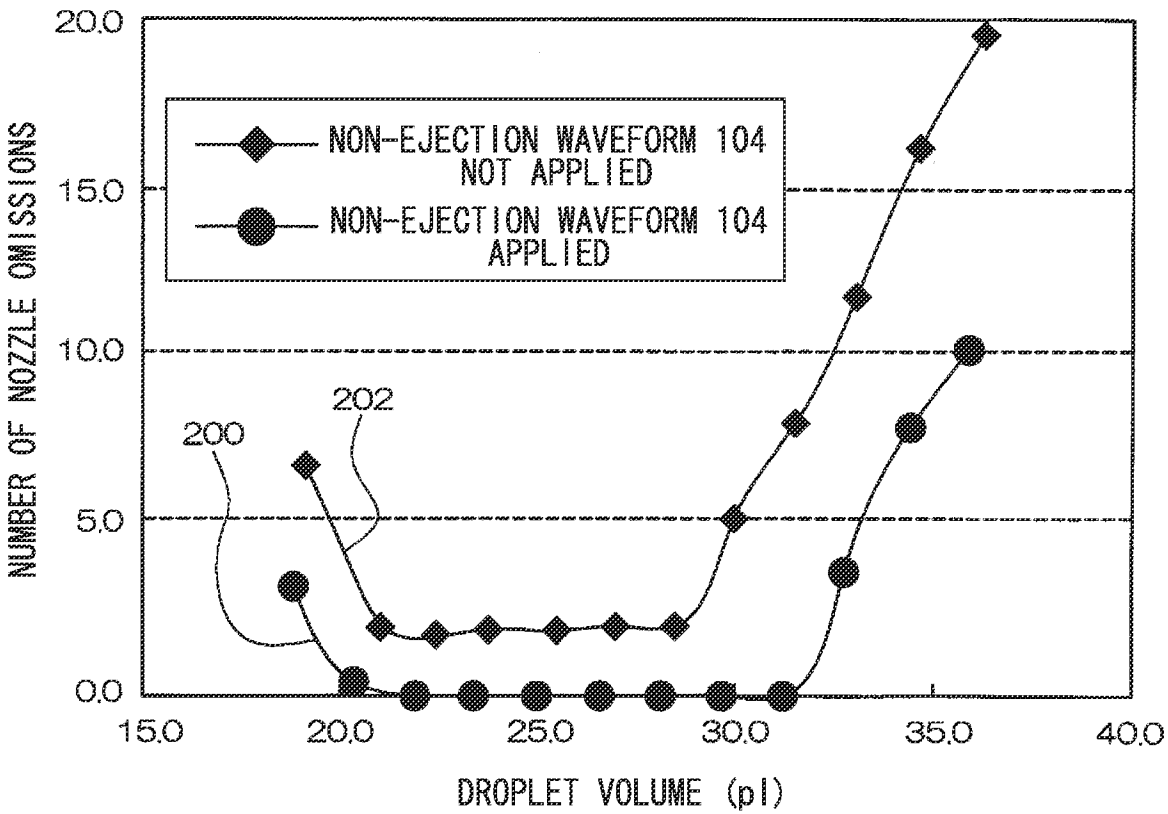
FIG. 7 is a diagram showing the effects of introducing a meniscus stabilizing waveform.

FIG. 7 shows the results of experiments to investigate whether or not nozzle omissions occur (namely, whether or not there are nozzles which fail to eject droplets) in consecutive ejection, and the effect of application of the meniscus stabilizing waveform 104. This investigation experiment involved performing ejection continuously for 5 minutes at an ejection frequency of 15 kHz from each one of 256 nozzles, and then counting the number of nozzles which failed to eject droplets. Furthermore, the number of nozzle omissions was measured under the same driving conditions, while changing the ejection volume per ejection. In this investigation experiment, the waveform 124 for forming the large size dot shown in FIG. 5C was employed, and the ejection volume was changed by altering the voltage of the ejection waveforms 102-1 to 102-3.

A curve 200 in FIG. 7 indicates the measurement results for the case where the meniscus stabilizing waveform 104 (see FIG. 5C) was added, and nozzle omissions did not occur in the droplet volume range from 20 picoliters to 30 picoliters, which corresponds to the large size dot and the medium size dot. On the other hand, a curve 202 indicates the measurement results for the case where the meniscus stabilizing waveform 104 was not added, and one or two nozzle omissions occurred in the droplet volume range of 20 picoliters to 30 to picoliters.

Consequently, in the case of three-pulse consecutive ejection for forming a large size dot, it is possible to reduce nozzle omissions by adding the meniscus stabilizing waveform 104. In the case of two-pulse consecutive ejection, the vibration of the meniscus is predicted to be smaller than in the case of three-pulse consecutive ejection, and hence, it is thought that similar results to the case of three-pulse consecutive ejection can be obtained.

Furthermore, one-pulse independent ejection action was performed using the drive waveform 120 in FIG. 3C, the image of the ejected liquid droplet during flight was captured by a high-speed video camera, and the occurrence or non-occurrence of satellite was confirmed. No satellite was observed when the satellite suppressing waveform 106 was added, whereas a satellite was observed when the satellite suppressing waveform 106 was not added. Consequently, in the case of one-pulse independent ejection action for forming a small size dot, the occurrence of satellite is suppressed by the addition of the satellite suppressing waveform 106.

The above-described inkjet recording apparatus 10 uses the drive method in which the standard drive waveform 100 includes three consecutive ejection waveforms 102-1, 102-2 and 102-3, the meniscus stabilizing waveform 104 following the three consecutive ejection waveforms 102-1 to 102-3, the independent ejection waveform 102-4 and the satellite suppressing waveform 106 following the ejection waveform 102-4; the ejection waveform 102-4 is selected when forming a small size dot, the ejection waveforms 102-2 and 102-3 are selected when forming a medium size dot, and the ejection waveforms 102-1, 102-2 and 102-3 are selected when forming a large size dot; and then the satellite suppressing waveform 106 is added after the ejection waveform 102-4 when forming the small size dot, and the meniscus stabilizing waveform 104 is added after the ejection waveform 102-3 when forming the medium size dot or the large size dot.

Consequently, in the case of forming a small size dot, the occurrence of satellite is suppressed and a dot having a desirable shape is formed, in addition to which, when forming a medium size dot and a large size dot, the behavior of the meniscus after ejection is stabilized and the occurrence of nozzle omissions can be reduced.

Moreover, since the required ejection waveform is extracted from the plurality of ejection waveforms 102 which are included in one standard drive waveform 100, and the ejected droplet volume (dot size) can be varied by using a portion of the ejection waveforms 102 or all of the ejection waveforms 102, then the waveform generating unit 18 which generates the standard drive waveform 100 needs only to generate the same standard drive waveform 100, all the time, and hence the composition of the waveform generating unit 18 can be simplified and the waveform generating unit 18 can be manufactured inexpensively.

Furthermore, the droplet ejection timing when forming a medium size dot or a large size dot (approximately, the falling portion of the ejection waveform 102-3) and the droplet ejection timing when forming a small size dot (approximately, the falling portion of the ejection waveform 102-4) are close together, and the time interval between the satellite suppressing waveform 106 and the ejection waveform 102-4 can be made shorter.

In the present embodiment, the mode has been described in which only one ejection waveform is selected when forming a dot of the smallest size, but it is also possible to adopt a mode in which a plurality of ejection waveforms are selected when forming a dot of the smallest size. Furthermore, the mode has been described in which dots having three different sizes are formed, but there may be two dot sizes or four or more dot sizes.

More specifically, it is possible to use a standard drive waveform including an ejection waveform group (first ejection waveform group) exceeding the number of ejection actions required in order to form one dot of the largest size, an ejection waveform group (second ejection waveform group) of the maximum number of ejection actions required in order to form one dot of a size that needs suppression of the occurrence of satellite (for example, a dot size employed in high-precision mode), a first non-ejection waveform which is added between the first ejection waveform group and the second ejection waveform group, and a second non-ejection waveform which is added after the second ejection waveform group.

Moreover, in the present embodiment, the mode has been described in which the number of ejection waveforms is selected in accordance with the dot size, from the standard drive waveform including the plurality of ejection waveforms that are the same, but it is also possible to employ a standard drive waveform that includes different ejection waveforms corresponding to different dot sizes.

More specifically, it is possible to change the waveform shapes between the ejection waveforms contained in the first ejection waveform group and the ejection waveforms contained in the second ejection waveform group described above, or to change the waveform shapes within the ejection waveforms included in the first ejection waveform group, or to change the waveform shapes within the ejection waveforms included in the second ejection waveform group.

For example, it is possible to adopt a composition in which, in the standard drive waveform 100 shown in FIG. 3A, the ejection waveform 102-2 and the ejection waveform 102-3 are joined together to form a combined ejection waveform, and when forming a medium size dot, the combined ejection waveform and the meniscus stabilizing waveform 104 are selected, and when forming a large size dot, the ejection waveform 102-1, the combined ejection waveform and the meniscus stabilizing waveform 104 are selected. Moreover, it is also possible to adopt a mode in which, instead of the ejection waveforms 102-1 to 102-3, a medium size ejection waveform and a large size ejection waveform are arranged at a prescribed time interval apart, and the meniscus stabilizing waveform 104 is arranged following same.

Furthermore, in the present embodiment, the mode has been described in which one meniscus stabilizing waveform 104 and one satellite suppressing waveform 106 are arranged in the standard drive waveform 100, but it is also possible to form the meniscus stabilizing waveform 104 and the satellite suppressing waveform 106 as waveform groups each including a plurality of waveforms, each waveform group collectively displaying action of stabilizing the meniscus or suppressing the occurrence of satellite. Moreover, the ejection waveform 102, the meniscus stabilizing waveform 104 and the satellite suppressing waveform 106 are not limited to the trapezoid shapes and may also employ a square waveform, a triangular waveform, or the like.

Second Embodiment

Next, a standard drive waveform according to a second embodiment of the present invention is described with reference to FIGS. 8A to 10C.

Figure 8A:
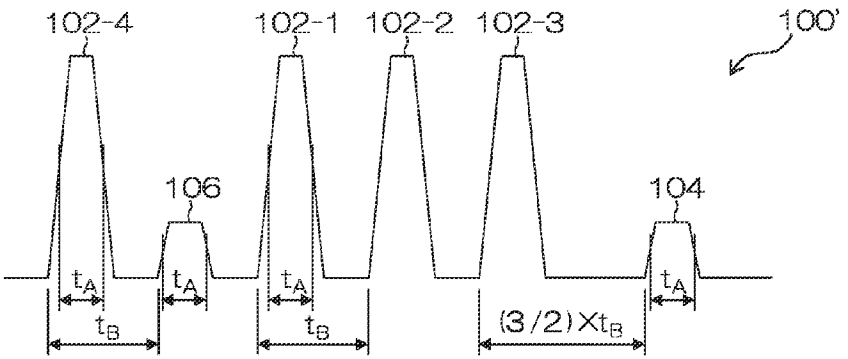
FIGS. 8A to 8C are diagrams for describing a drive waveform for ejection of a small droplet according to the second embodiment of the present invention.

FIG. 8A is a diagram showing a schematic view of a standard drive waveform 100' corresponding to one ejection cycle, according to the second embodiment of the present invention, in which the horizontal axis represents time and the vertical axis represents voltage. The standard drive waveform 100' shown in FIGS. 9A and 10A referenced in the following description is the same as the standard drive waveform 100' shown in FIG. 8A. Parts which are the same as or similar to the first embodiment described above are denoted with the same reference numerals and further explanation thereof is omitted here.

In the standard drive waveform 100' shown in FIG. 8A, the order of the waveform elements is changed in comparison with the standard drive waveform 100 shown in FIG. 3A, and the first ejection waveform group and the second ejection waveform group are interchanged. On the other hand, the standard drive waveform 100' is the same as the standard drive waveform 100 shown in FIG. 3A in that the satellite suppressing waveform 106 is arranged after the second ejection waveform group, and the meniscus stabilizing waveform 104 is arranged after the first ejection waveform group.

More specifically, in the standard drive waveform 100' shown in FIG. 8A, the independent ejection waveform 102-4 is arranged at the start and the satellite suppressing waveform 106 is arranged after the ejection waveform 102-4. The three ejection waveforms 102-1, 102-2 and 102-3 are arranged following the satellite suppressing waveform 106, and the meniscus stabilizing waveform 104 is arranged after the ejection waveform 102-3.

Figure 8B:
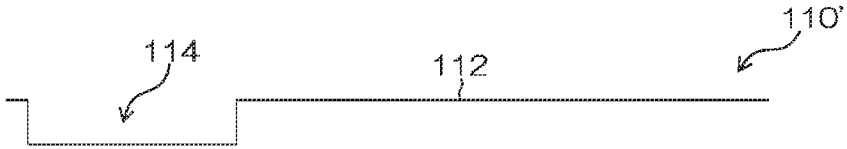
Figure 8C:
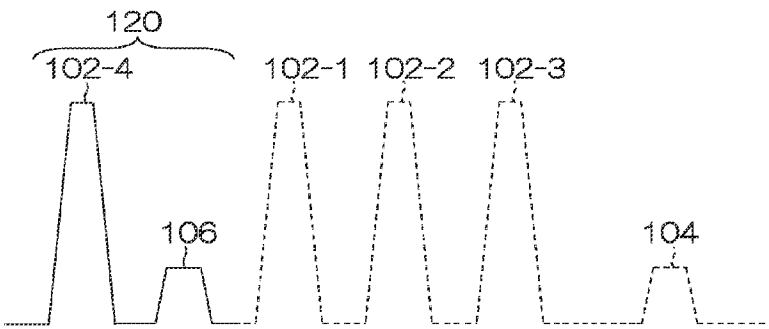

The waveform selection signal 110' shown in FIG. 8B is used when the drive waveform for forming a small size dot is extracted from the standard drive waveform 100' shown in FIG. 8A. Taking the logical sum of the standard drive waveform 100' and the waveform selection signal 110', the drive waveform 120 for forming the small size dot is generated as shown in FIG. 8C.

Figure 9A:
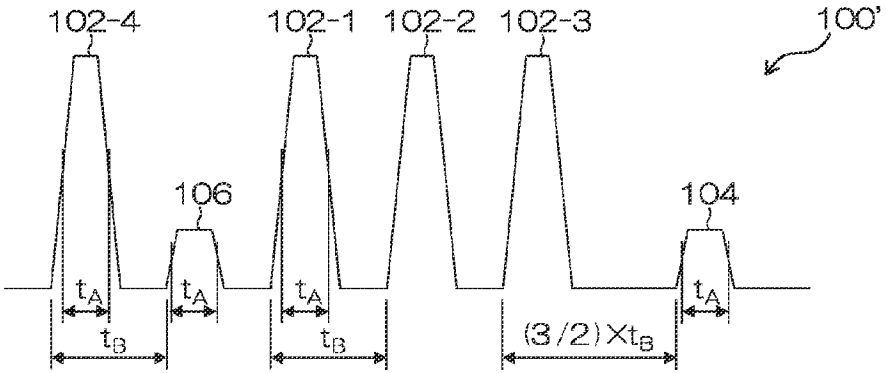
FIGS. 9A to 9C are diagrams for describing a drive waveform for ejection of a medium droplet according to the second embodiment of the present invention.
Figure 9B:
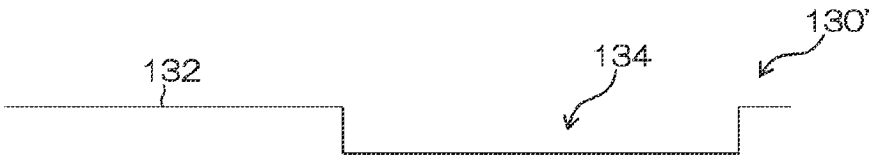
Figure 9C:
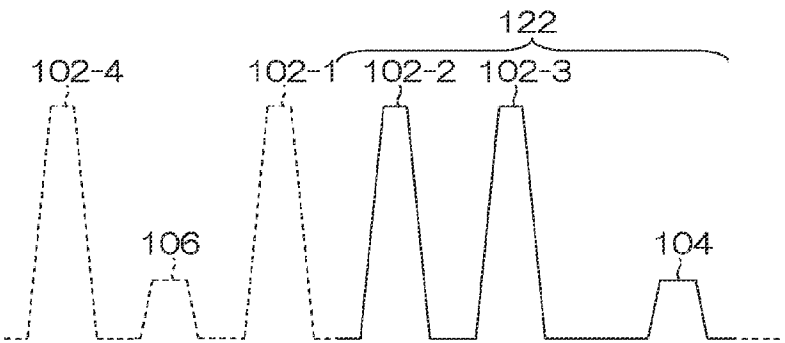
Figure 10A:
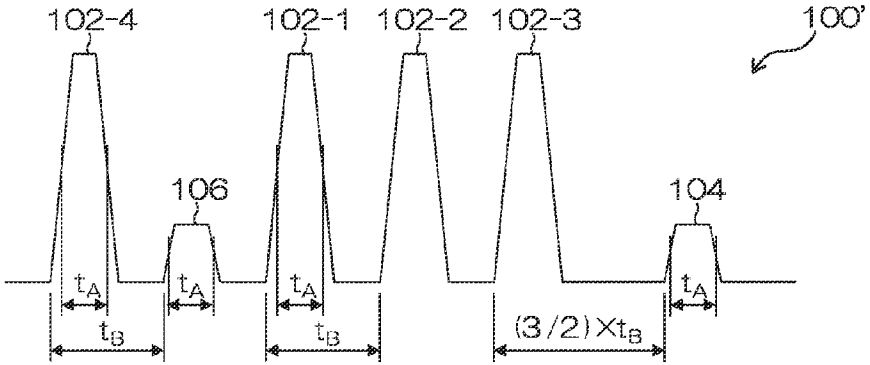
FIGS. 10A to 10C are diagrams for describing a drive waveform for ejection of a large droplet according to the second embodiment of the present invention.
Figure 10B:
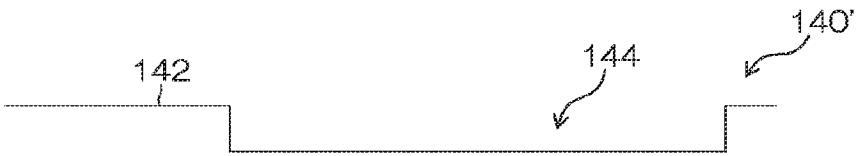
Figure 10C:
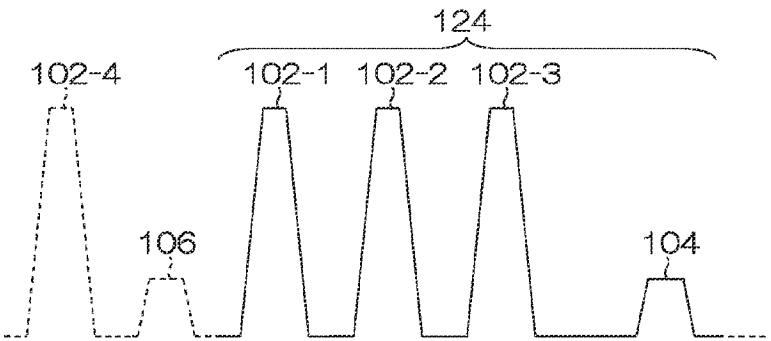

FIG. 9B shows a waveform selection signal 130' for generating a drive waveform for forming a medium size dot. Taking the logical sum of the standard drive waveform 100' and the waveform selection signal 130', the drive waveform 122 for forming the medium size dot is generated as shown in FIG. 9C. Similarly, taking the logical sum of the standard drive waveform 100' and a waveform selection signal 140' for forming a large size dot shown in FIG. 10B, the drive waveform 124 for forming the large size dot is generated as shown in FIG. 10C.

The pulse width $t_A$ and the pulse interval $t_B$ in the standard drive waveform 100' shown in FIGS. 8A to 10A can be the same as in the first embodiment described above. Furthermore, the phase relationship between the meniscus stabilizing waveform 104 and the meniscus vibration, and the phase relationship between the satellite suppressing waveform 106 and the meniscus vibration can be the same as in the first embodiment described above.

Third Embodiment

Next, a drive waveform according to a third embodiment of the present invention is described. The drive signal according to the present embodiment ensures ejection stability in a case where a large droplet is ejected, by adding a non-drive waveform (satellite suppressing waveform 106) immediately before ejecting the large droplet.

Figure 11A:
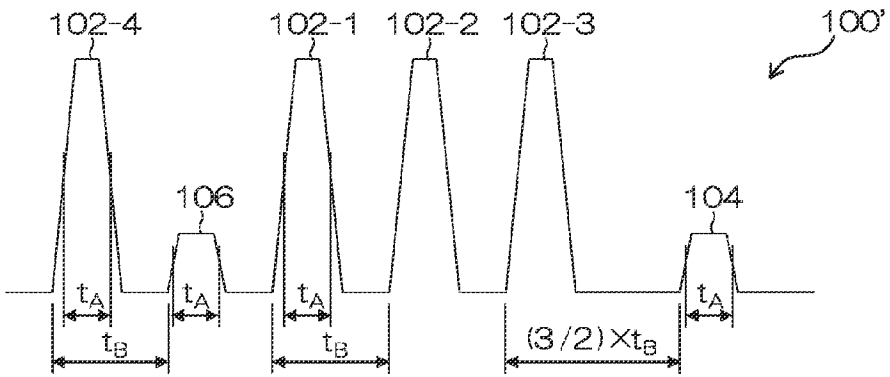
FIGS. 11A to 11C are diagrams for describing a drive waveform for ejection of a large droplet according to the third embodiment of the present invention.
Figure 11B:
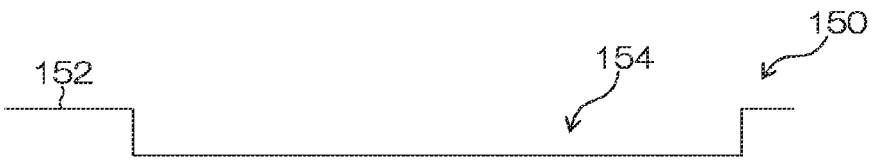
Figure 11C:
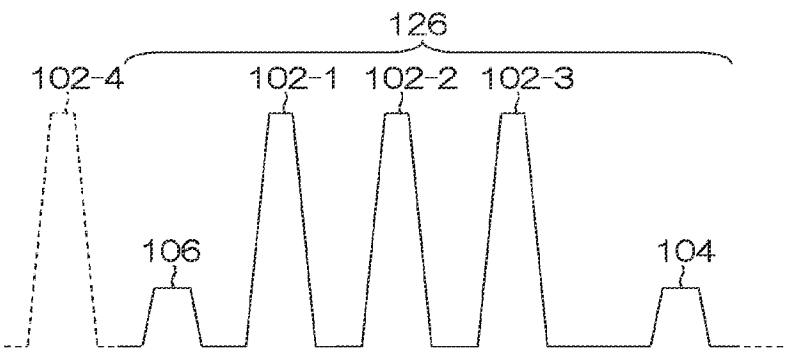

In a drive waveform 126 shown in FIG. 11C, the satellite suppressing waveform 106 is added at the start of the drive waveform 124 (see FIG. 10C) for forming a large size dot. More specifically, the drive waveform 126 shown in FIG. 11C is generated when the satellite suppressing waveform 106, the ejection waveforms 102-1, 102-2 and 102-3 and the meniscus stabilizing waveform 104 are selected by a waveform selection signal 150 shown in FIG. 11B from the standard drive waveform 100' shown in FIG. 11A.

In the drive waveform 126, the satellite suppressing waveform 106 acts as a meniscus vibrating waveform immediately before ejection of droplets, and sets the meniscus to a better state for forming a large size dot. More specifically, due to the effects of vibrating the meniscus immediately before ejection, it is possible to make the ejection volume of the large size droplet approach an ideal volume, and hence the graduation of the droplet volume (the difference with respect to a medium size droplet) can be made more distinct.

It is possible to apply the present embodiment to the first embodiment, by adding a non-ejection waveform, namely, the satellite suppressing waveform 106 or the meniscus stabilizing waveform 104, at the start of the standard drive waveform 100 shown in FIG. 3A, and changing the waveform selection signal in such a manner that the non-ejection waveform at the start is added when forming a large size dot.

Fourth Embodiment

Next, a drive waveform according to a fourth embodiment of the present invention is described. The drive waveform in the present embodiment supplies a drive signal constituted of a drive waveform (referred to as a "drive waveform for an idle nozzle") that includes only one or more of non-ejection waveforms, to a non-ejecting nozzle (idle nozzle).

Figure 12A:
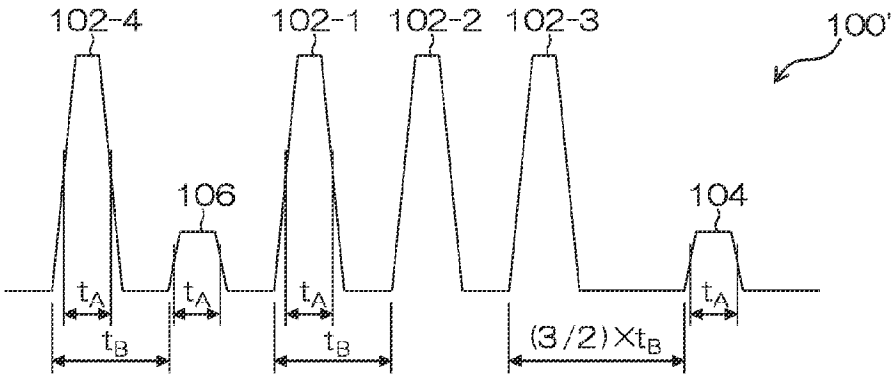
FIGS. 12A to 12C are diagrams for describing a drive waveform according to the fourth embodiment of the present invention.
Figure 12B:
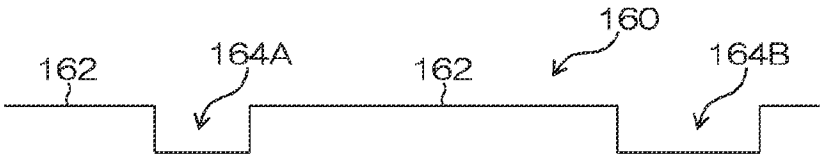

More specifically, a waveform selection signal 160 shown in FIG. 12B includes two L levels 164A and 164B corresponding to the non-ejection waveforms 104 and 106. The first L level 164A corresponds to the satellite suppressing waveform 106, and the second L level 164B corresponds to the meniscus stabilizing waveform 104. Taking the logical sum of the standard drive waveform 100' shown in FIG. 12A and the waveform selection signal 160 shown in FIG. 12B, a drive waveform 128 including only the non-ejection waveforms (i.e., the meniscus stabilizing waveform 104 and the satellite suppressing waveform 106) is generated as shown in FIG. 12C.

In inkjet heads, decline in image quality may arise due to a fall in the droplet ejection speed or the occurrence of ejection failure in an initial ejection operation after an idle period. This is because the viscosity of the liquid inside the nozzle increases during the idle period and hence the ejection characteristics deteriorate. By applying a drive signal constituted of a drive signal for an idle nozzle, to the piezoelectric actuator that corresponds to a nozzle during an idle period, the liquid inside the nozzle is churned while being pressurized to an extent that does not cause ejection, and hence prescribed ejection characteristics are maintained without any marked deterioration in the ejection speed of droplets immediately after an idle period.

Figure 12C:
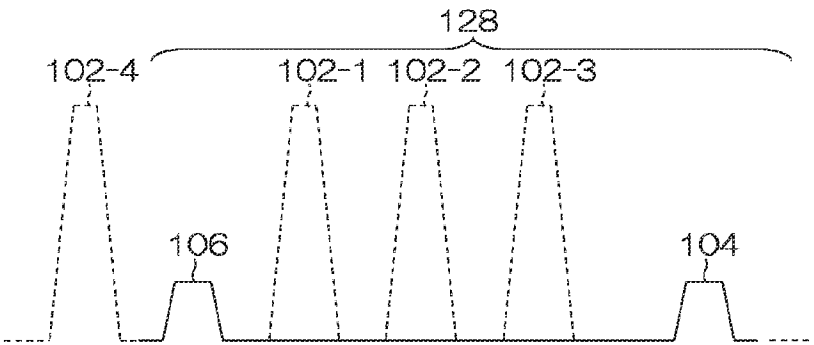

FIGS. 12A to 12C show a mode where the drive waveform 128 is generated on the basis of the standard drive waveform 100' in the second embodiment, but it is also possible to adopt a composition in which a drive waveform for an idle nozzle is generated on the basis of the standard drive waveform 100 in the first embodiment.

Figure 13:
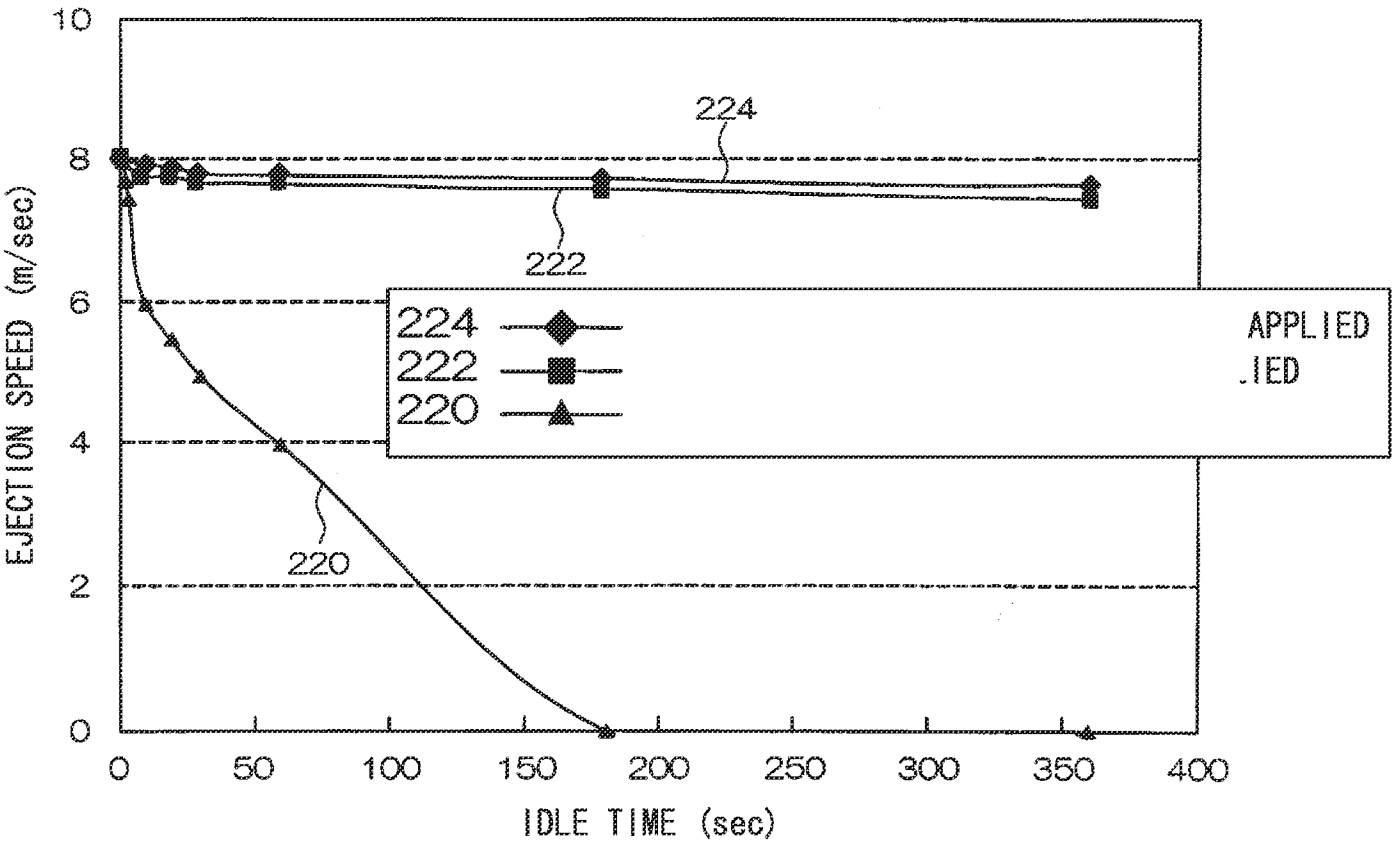
FIG. 13 is a diagram illustrating the effects of the fourth embodiment of the present invention.

FIG. 13 shows the effects of the present embodiment, in which the horizontal axis represents the idle time (sec), the vertical axis represents the droplet ejection speed (m/sec), and shows results of the measurement of droplet speed in a first ejection operation immediately after a prescribed idle time.

A curve 220 in FIG. 13 relates to a case where no drive signal constituted of a drive waveform for an idle nozzle is applied to a nozzle during an idle state, and it can be seen that the ejection speed dramatically reduces and furthermore, that the ejection speed falls as the idle time increases. Furthermore, it can also be seen that when the idle time exceeds 180 seconds, then ejection failure occurs (i.e., the ejection speed becomes zero).

On the other hand, a curve 222 shows the ejection characteristics in a case where a drive signal constituted of the drive waveform for an idle nozzle, which includes only the satellite suppressing waveform 106, is applied to a nozzle during an idle state, and a curve 224 shows the ejection characteristics in a case where a drive signal constituted of a drive waveform for an idle nozzle, which includes both the meniscus stabilizing waveform 104 and the satellite suppressing waveform 106, is applied to a nozzle during an idle state. In both of these cases, no marked decline is observed in the ejection speed of the ejection immediately after an idle period, and furthermore, it can be seen that there is no marked fall in the ejection speed of droplet immediately after an idle period, even if the idle period is long.

In the present embodiment, the mode has been described in which the drive signal constituted of the drive waveform for an idle nozzle is generated on the basis of the standard drive waveform 100' in the second embodiment, but it is also possible to generate a drive signal constituted of a drive waveform for an idle nozzle on the basis of the standard drive waveform 100 in the first embodiment.

According to the fourth embodiment, a drive signal constituted of the drive waveform 128, which includes only the non-ejection waveforms 104 and 106 (i.e., not including an ejection waveform 102), is supplied to an idle nozzle, and therefore prescribed ejection characteristics are maintained without any decline in the droplet ejection speed in the first ejection operation immediately after the idle period.

Embodiment of Application in Inkjet System

Next, an embodiment in which the above-described inkjet ejection apparatus is applied to an inkjet system or inkjet recording apparatus of the on-demand type is described.

<General Composition of Inkjet Recording Apparatus>

Figure 14:
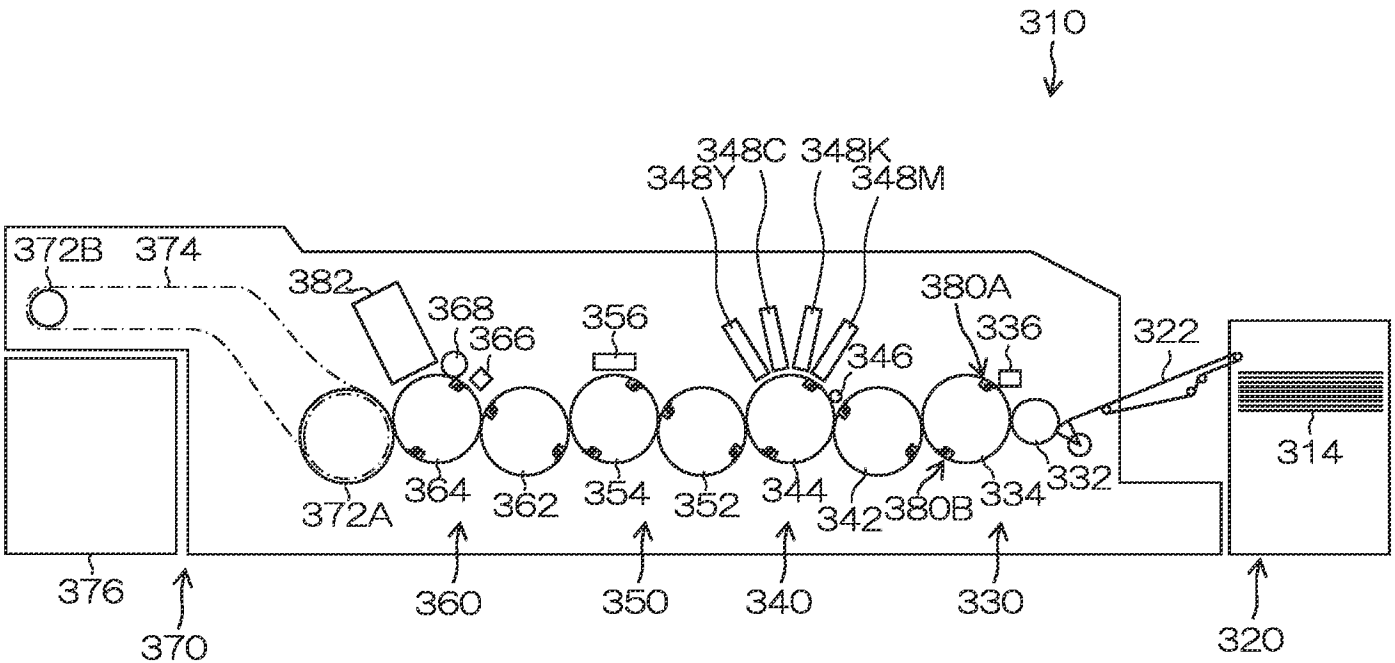
FIG. 14 is a general schematic drawing of an inkjet recording apparatus to which the inkjet ejection apparatus according to the present invention is applied.

FIG. 14 is a schematic drawing showing the general composition of the inkjet recording apparatus according to the present embodiment. The inkjet recording apparatus 310 shown in FIG. 14 is a recording apparatus based on a two-liquid aggregation system which forms an image on a recording surface of a recording medium 314 on the basis of prescribed image data, by using ink containing coloring material and an aggregating treatment liquid having a function of aggregating the ink.

The inkjet recording apparatus 310 includes a paper feed unit 320, the treatment liquid application unit 330, an image formation unit 340, a drying process unit 350, a fixing process unit 360 and an output unit 370. Transfer drums 332, 342, 352 and 362 are arranged as devices which receive and transfer the recording medium 314 conveyed respectively from stages prior to the treatment liquid application unit 330, the image formation unit 340, the drying process unit 350, and the fixing process unit 360. Pressure drums 334, 344, 354 and 364 having a drum shape are arranged as devices for holding and conveying the recording medium 314 respectively in the treatment liquid application unit 330, the image formation unit 340, the drying process unit 350 and the fixing process unit 360.

Each of the transfer drums 332 to 362 and the pressure drums 334 to 364 is provided with grippers 380A and 380B, which grip and hold the leading end portion (or the trailing end portion) of the recording medium 314. The gripper 380A and the gripper 380B adopt a common structure for gripping and holding the leading end portion of the recording medium 314 and for transferring the recording medium 314 with respect to the gripper arranged in another pressure drum or transfer drum; furthermore, the gripper 380A and the gripper 380B are disposed in symmetrical positions separated by 180° in the direction of rotation of the pressure drum 334 on the outer circumferential surface of the pressure drum 334.

When the transfer drums 332 to 362 and the pressure drums 334 to 364 which have gripped the leading end portion of the recording medium 314 by means of the grippers 380A and 380B rotate in a prescribed rotational direction, the recording medium 314 is rotated and conveyed following the outer circumferential surface of the transfer drums 332 to 362 and the pressure drums 334 to 364.

In FIG. 14, only the reference numerals of the grippers 380A and 380B arranged on the pressure drum 334 are indicated, and the reference numerals of the grippers on the other pressure drums and transfer drums are not shown.

When the recording medium (cut sheet paper) 314 accommodated in a paper feed unit 320 is supplied to the treatment liquid application unit 330, the aggregating treatment liquid (hereinafter referred to simply as "treatment liquid") is applied to the recording surface of the recording medium 314 held on the outer circumferential surface of the pressure drum 334. The "recording surface of the recording medium 314" is the outer surface when the recording medium 314 is held by the pressure drums 334 to 364, this being reverse to the surface held on the pressure drums 334 to 364.

Thereupon, the recording medium 314 on which the aggregating treatment liquid has been applied is output to the image formation unit 340 and colored inks are deposited by the image formation unit 340 onto the area of the recording surface where the aggregating treatment liquid has been applied, thereby forming a desired image.

Moreover, the recording medium 314 on which the image has been formed by the colored inks is sent to the drying process unit 350, and a drying process is carried out by the drying process unit 350. After the drying process, the recording medium 314 is conveyed to the fixing process unit 360, and a fixing process is carried out. By carrying out the drying process and the fixing process, the image formed on the recording medium 314 is made durable. In this way, the desired image is formed on the recording surface of the recording medium 314 and after fixing the image on the recording surface of the recording medium 314, the recording medium 314 is conveyed to the exterior of the inkjet recording apparatus 310 through the output unit 370.

The respective units of the inkjet recording apparatus 310 (paper feed unit 320, treatment liquid application unit 330, image formation unit 340, drying process unit 350, fixing process unit 360 and output unit 370) are described in detail below.

<Paper Feed Unit>

The paper feed unit 320 includes a paper feed tray 322 and a paying out mechanism (not shown), and is composed so as to pay out the recording medium 314 one sheet at a time from the paper feed tray 322. The recording medium 314 paid out from the paper feed tray 322 is registered in position by a guide member (not shown) and halted temporarily in such a manner that the leading end portion is disposed at the position of the gripper (not shown) on the transfer drum (paper feed drum) 332.

<Treatment Liquid Application Unit>

The treatment liquid application unit 330 includes: a pressure drum (treatment liquid drum) 334, which holds, on the outer circumferential surface thereof, the recording medium 314 transferred from the paper feed drum 332 and conveys the recording medium 314 in the prescribed conveyance direction; and the treatment liquid application device 336, which applies the treatment liquid to the recording surface of the recording medium 314 held on the outer circumferential surface of the treatment liquid drum 334. When the treatment liquid drum 334 is rotated in the counter-clockwise direction in FIG. 14, the recording medium 314 is conveyed so as to rotate in the counter-clockwise direction following the outer circumferential surface of the treatment liquid drum 334.

The treatment liquid application device 336 shown in FIG. 14 is arranged at a position facing the outer circumferential surface (recording medium holding surface) of the treatment liquid drum 334. One example of the composition of the treatment liquid application device 336 is a mode which includes: a treatment liquid vessel, which stores the treatment liquid; an uptake roller, which is partially immersed in the treatment liquid in the treatment liquid vessel and takes up the treatment liquid from the treatment liquid vessel; and an application roller (rubber roller), which moves the treatment liquid taken up by the uptake roller onto the recording medium 314.

A desirable mode is one which includes an application roller movement mechanism, which moves the application roller in the upward and downward direction (the normal direction with respect to the outer circumferential surface of the treatment liquid drum 334), so as to be able to avoid collisions between the application roller and the grippers 380A and 380B.

The treatment liquid applied on the recording medium 314 by the treatment liquid application device 336 contains a coloring material aggregating agent, which aggregates the coloring material (pigment) in the ink to be deposited by the image formation unit 340, and when the treatment liquid and the ink come into contact with each other on the recording medium 314, the separation of the coloring material and the solvent in the ink is promoted.

It is desirable that the treatment liquid application device 336 doses the amount of treatment liquid applied to the recording medium 314 while applying the treatment liquid, and that the thickness of the film of treatment liquid on the recording medium 314 is sufficiently smaller than the diameter of the ink droplets which are ejected from the image formation unit 340.

<Image Formation Unit>

The image formation unit 340 includes: a pressure drum (image formation drum) 344, which holds and conveys the recording medium 314; a paper pressing roller 346 for causing the recording medium 314 to adhere tightly to the image formation drum 344; and inkjet heads 348M, 348K, 348C and 348Y, which deposit the inks onto the recording medium 314. The basic structure of the image formation drum 344 is common to that of the treatment liquid drum 334, which is described previously, and therefore the description of it is omitted here.

The paper pressing roller 346 is a guide member for causing the recording medium 314 to make tight contact with the outer circumferential surface of the image formation drum 344, and is disposed facing the outer circumferential surface of the image formation drum 344, to the downstream side, in terms of the conveyance direction of the recording medium 314, of the transfer position of the recording medium 314 between the transfer drum 342 and the image formation drum 344 and to the upstream side, in terms of the conveyance direction of the recording medium 314, of the inkjet heads 348M, 348K, 348C and 348Y.

When the recording medium 314 that has been transferred from the transfer drum 342 to the image formation drum 344 is conveyed to rotate in a state where the leading end is held by the gripper (not denoted with reference numeral), the recording medium 314 is pressed by the paper pressing roller 346 and is caused to make tight contact with the outer circumferential surface of the image formation drum 344. After the recording medium 314 has been caused to make tight contact with the outer circumferential surface of the image formation drum 344 in this way, the recording medium 314 is passed to a printing region directly below the inkjet heads 348M, 348K, 348C and 348Y, without any floating up of the recording medium 314 from the outer circumferential surface of the image formation drum 344.

The inkjet heads 348M, 348K, 348C and 348Y respectively correspond to the inks of the four colors of magenta (M), black (K), cyan (C) and yellow (Y), and are disposed in this order from the upstream side in terms of the direction of rotation of the image formation drum 344 (the counter-clockwise direction in FIG. 14), and ink ejection surfaces (nozzle surfaces) of the inkjet heads 348M, 348K, 348C and 348Y are disposed so as to face the recording surface of the recording medium 314 that is held on the image formation drum 344. Here, the "ink ejection surfaces (nozzle surfaces)" are surfaces of the inkjet heads 348M, 348K, 348C and 348Y which face the recording surface of the recording medium 314, and are the surfaces where the nozzles (denoted with reference numeral 328 in FIG. 17) which eject the inks as described below are formed.

Furthermore, the inkjet heads 348M, 348K, 348C and 348Y shown in FIG. 14 are disposed at an inclination with respect to the horizontal plane in such a manner that the nozzle surfaces of the inkjet heads 348M, 348K, 348C and 348M are substantially parallel to the recording surface of the recording medium 314 that is held on the outer circumferential surface of the image formation drum 344.

The inkjet heads 348M, 348K, 348C and 348Y are full line heads having a length corresponding to the maximum width of the image forming region on the recording medium 314 (the dimension of the recording medium 314 in the direction perpendicular to the conveyance direction), and are fixed so as to extend in a direction perpendicular to the conveyance direction of the recording medium 314.

Nozzles for ejecting the inks are formed in a matrix configuration on the nozzle surfaces of the inkjet heads 348M, 348K, 348C and 348Y throughout the whole width of the image forming region of the recording medium 314.

When the recording medium 314 is conveyed to a printing region directly below the inkjet heads 348M, 348K, 348C and 348Y, inks of respective colors are ejected as droplets on the basis of image data, from the inkjet heads 348M, 348K, 348C and 348Y and deposited onto the region of the recording medium 314 where the aggregating treatment liquid has been applied.

When the droplets of the colored inks are ejected from the corresponding inkjet heads 348M, 348K, 348C and 348Y toward the recording surface of the recording medium 314 held on the outer circumferential surface of the image formation drum 344, the inks make contact with the treatment liquid on the recording medium 314, and an aggregating reaction occurs with coloring material (pigment-based coloring material) that is dispersed in the inks or coloring material (dye-based coloring material) that can be insolubilized, thereby forming an aggregate of the coloring material. Thus, movement of the coloring material in the image formed on the recording medium 314 (namely, positional displacement of the dots, color non-uniformities of the dots) is prevented. Furthermore, the image formation drum 344 of the image formation unit 340 is structurally separate from the treatment liquid drum 334 of the treatment liquid application unit 330, and therefore the treatment liquid is never applied to the inkjet heads 348M, 348K, 348C and 348Y, and it is possible to reduce the causes of ink ejection abnormalities.

Although a configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

The inkjet ejection apparatus 10 described above with reference to FIGS. 1 to 13 is applied to the image formation unit 340 in the inkjet recording apparatus shown in FIG. 14.

<Drying Process Unit>

The drying process unit 350 includes: a pressure drum (drying drum) 354, which holds and conveys the recording medium 314 after image formation; and a solvent drying unit 356, which carries out a drying process for evaporating off the water content (liquid component) on the recording medium 314. The basic structure of the drying drum 354 is common to that of the treatment liquid drum 434 and the image formation drum 344 described previously, and therefore further description thereof is omitted here.

The solvent drying unit 356 is a processing unit which is disposed in a position facing the outer circumferential surface of the drying drum 354 and evaporates off the water content present on the recording medium 314. When the ink is deposited on the recording medium 314 by the image formation unit 340, the liquid component (solvent component) of the ink and the liquid component (solvent component) of the treatment liquid that have been separated by the aggregating reaction between the treatment liquid and the ink remain on the recording medium 314, and therefore it is necessary to remove this liquid component.

The solvent drying unit 356 is a processing unit which carries out a drying process by evaporating off the liquid component present on the recording medium 314, through heating by a heater, or air blowing by a fan, or a combination of these, in order to remove the liquid component on the recording medium 314. The amount of heating and the air flow volume applied to the recording medium 314 are set appropriately in accordance with parameters, such as the amount of water remaining on the recording medium 314, the type of recording medium 314, the conveyance speed of the recording medium 314 (interference processing time), and the like.

When the drying process is carried out by the solvent drying unit 356, since the drying drum 354 of the drying process unit 350 is structurally separate from the image formation drum 344 of the image formation unit 340, then it is possible to reduce the causes of ink ejection abnormalities due to drying of the head meniscus portions in the inkjet heads 348M, 348K, 348C and 348Y as a result of the applied heat or air flow.

In order to display an effect in correcting cockling of the recording medium 314, the curvature of the drying drum 354 is desirably 0.002 (1/mm) or greater. Furthermore, in order to prevent curving (curling) of the recording medium after the drying process, the curvature of the drying drum 354 is desirably 0.0033 (1/mm) or less.

Moreover, desirably, a device for adjusting the surface temperature of the drying drum 354 (for example, an internal heater) may be provided to adjust the surface temperature to 50° C. or above. Drying is promoted by carrying out a heating process from the rear surface of the recording medium 314, thereby preventing destruction of the image in the subsequent fixing process. According to this mode, more beneficial effects are obtained if a device for causing the recording medium 314 to adhere tightly to the outer circumferential surface of the drying drum 354 is provided. Examples of a device for causing tight adherence of the recording medium 314 include a vacuum suction device, electrostatic attraction device or the like.

There are no particular restrictions on the upper limit of the surface temperature of the drying drum 354, but from the viewpoint of the safety of maintenance operations such as cleaning the ink adhering to the surface of the drying drum 354 (e.g. preventing burns due to high temperature), desirably, the surface temperature of the drying drum 354 is not higher than 75° C. (and more desirably, not higher than 60° C.).

By holding the recording medium 314 in such a manner that the recording surface thereof is facing outward on the outer circumferential surface of the drying drum 354 having this composition (in other words, in a state where the recording surface of the recording medium 314 is curved in a projection shape), and carrying out the drying process while conveying the recording medium 314 in rotation, it is possible reliably to prevent drying non-uniformities caused by wrinkling or floating up of the recording medium 314.

<Fixing Process Unit>

The fixing process unit 360 includes: a pressure drum (fixing drum) 364, which holds and conveys the recording medium 314; a heater 366, which carries out a heating process on the recording medium 314 which the image has been formed on and the liquid has been removed from; and a fixing roller 368, which presses the recording medium 314 from the recording surface side. The basic structure of the fixing drum 364 is common to that of the treatment liquid drum 334, the image formation drum 344 and the drying drum 354, and description thereof is omitted here. The heater 366 and the fixing roller 368 are disposed in positions facing the outer circumferential surface of the fixing drum 364, and are situated in this order from the upstream side in terms of the direction of rotation of the fixing drum 364 (the counterclockwise direction in FIG. 14).

In the fixing process unit 60, a preliminary heating process by means of the heater 366 is carried out onto the recording surface of the recording medium 314, and a fixing process by means of the fixing roller 368 is also carried out. The heating temperature of the heater 366 is set appropriately in accordance with the type of the recording medium, the type of ink (the type of polymer particles contained in the ink), and the like. For example, a possible mode is one where the heating temperature is set to the glass transition temperature or the minimum film forming temperature of the polymer particles contained in the ink.

The fixing roller 368 is a roller member for melting the self-dispersing polymer particles contained in the ink and thereby causing a state where the ink is covered with a film, by applying heat and pressure to the dried ink, and is composed so as to apply heat and pressure to the recording medium 314. More specifically, the fixing roller 368 is disposed so as to contact and press against the fixing drum 364, in such a manner that the fixing roller 368 serves as a nip roller with respect to the fixing drum 364. By this means, the recording medium 314 is held between the fixing roller 368 and the fixing drum 364 and is nipped with a prescribed nip pressure, whereby the fixing process is carried out.

An example of the composition of the fixing roller 368 is a mode where the fixing roller 368 is constituted of a heating roller which incorporates a halogen lamp inside a metal pipe made of aluminum, or the like, having good heat conductivity. If heat energy at or above the glass transition temperature of the polymer particles contained in the ink is applied by heating the recording medium 314 by means of this heating roller, then the polymer particles melt and a transparent film is formed on the surface of the image.

By applying pressure to the recording surface of the recording medium 314 in this state, the polymer particles which have melted are pressed and fixed into the undulations in the recording medium 314, and the undulations in the image surface are thereby leveled out, thus making it possible to obtain a desirable luster. A desirable composition is one where fixing rollers 368 are provided in a plurality of stages, in accordance with the thickness of the image layer and the glass transition temperature characteristics of the polymer particles.

Furthermore, desirably, the surface hardness of the fixing roller 368 is not higher than 71°. By further softening the surface of the fixing roller 368, it is possible to expect effects in following the undulations of the recording medium 314 which are produced by cockling, and fixing non-uniformities caused by the undulations of the recording medium 314 are prevented more effectively.

The inkjet recording apparatus 310 shown in FIG. 14 includes an in-line sensor 382, which is arranged at a later stage of the processing region of the fixing process unit 360 (on the downstream side in terms of the direction of conveyance of the recording medium). The in-line sensor 382 is a sensor for reading the image formed on the recording medium 314 (or a test pattern (check pattern) formed in the margin area of the recording medium 314), and desirably employs a CCD line sensor.

In the inkjet recording apparatus 310 in the present embodiment, the presence and absence of ejection abnormalities in the inkjet heads 348M, 348K, 348C and 348Y are judged on the basis of the reading results of the in-line sensor 382, which is below described more specifically. Furthermore, the in-line sensor 382 may include measurement devices for measuring the water content, surface temperature, luster (gloss level), and the like. According to this mode, parameters, such as the processing temperature of the drying process unit 350 and the heating temperature and applied pressure of the fixing process unit 360, are adjusted appropriately on the basis of the read result for the water content, surface temperature and luster, and thereby the above control parameters are properly controlled in accordance with the temperature alteration inside the apparatus and the temperature alteration of the respective parts.

<Output Unit>

As shown in FIG. 14, the output unit 370 is arranged subsequently to the fixing process unit 360. The output unit 370 includes an endless conveyance belt 474 wrapped about tensioning rollers 472A and 472B, and an output tray 476, in which the recording medium 314 after the image formation is accommodated.

The recording medium 314 that has undergone the fixing process and output from the fixing process unit 360 is conveyed by the conveyance belt 474 and output to the output tray 476.

<Structure of Inkjet Head>

Figure 15:
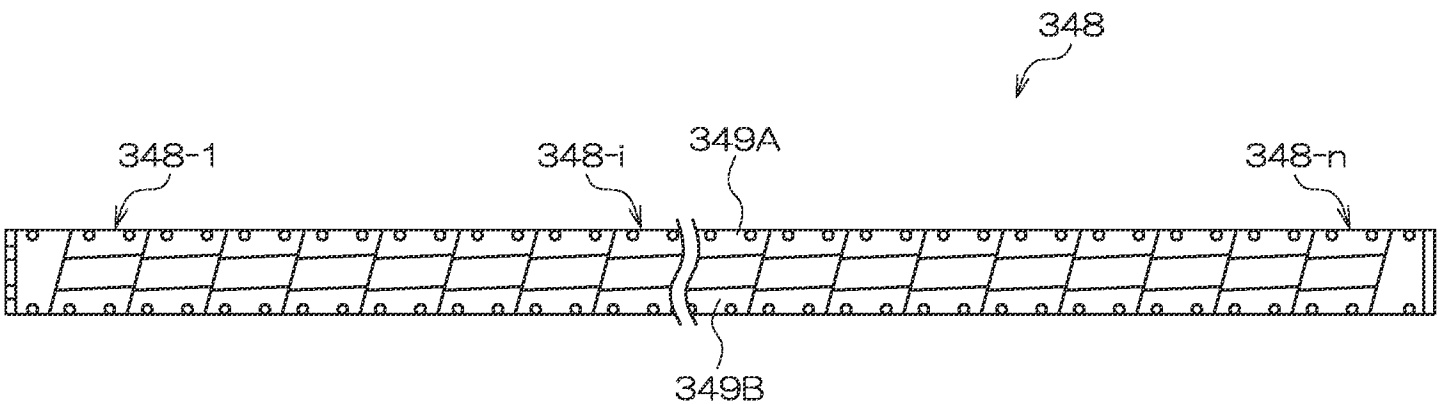
FIG. 15 is a plan view perspective diagram of an inkjet head in the inkjet recording apparatus shown in FIG. 14.

FIG. 15 is a general schematic drawing of the inkjet head employed in the present embodiment, which shows a plan view perspective diagram of the head as viewing from the inkjet head toward a recording surface of a recording medium. The inkjet heads 348M, 348K, 348C and 348Y shown in FIG. 14 have the same structure, and therefore in the following description, each of these is referred as the "inkjet head 348", unless there is a need to differentiate between the inkjet heads 348M, 348K, 348C and 348Y.

The inkjet head 348 shown in FIG. 15 forms a multi-head by joining together n sub-heads 348-*i* (where i is an integer from 1 to n) in a row. The sub-heads 348-*i* are supported by head covers 349A and 349B from either side of the width direction of the inkjet head 348. It is also possible to constitute a multi-head by arranging sub-heads 348 in a staggered configuration.

One embodiment of the application of the multi-head constituted of the sub-heads is a full-line head, which corresponds to the entire width of a recording medium. The full line head has a structure in which the nozzles (denoted with reference numeral 328 in FIG. 17) are arranged through the dimension (width) of the recording medium in a main scanning direction, following the direction (the main scanning direction) which is perpendicular to the direction of movement of the recording medium (the sub-scanning direction). An image can be formed over the full surface of the recording medium by means of a so-called single-pass image recording method in which image recording is carried out by performing one relative movement action of the inkjet head 348 having this structure and the recording medium.

Figure 16:
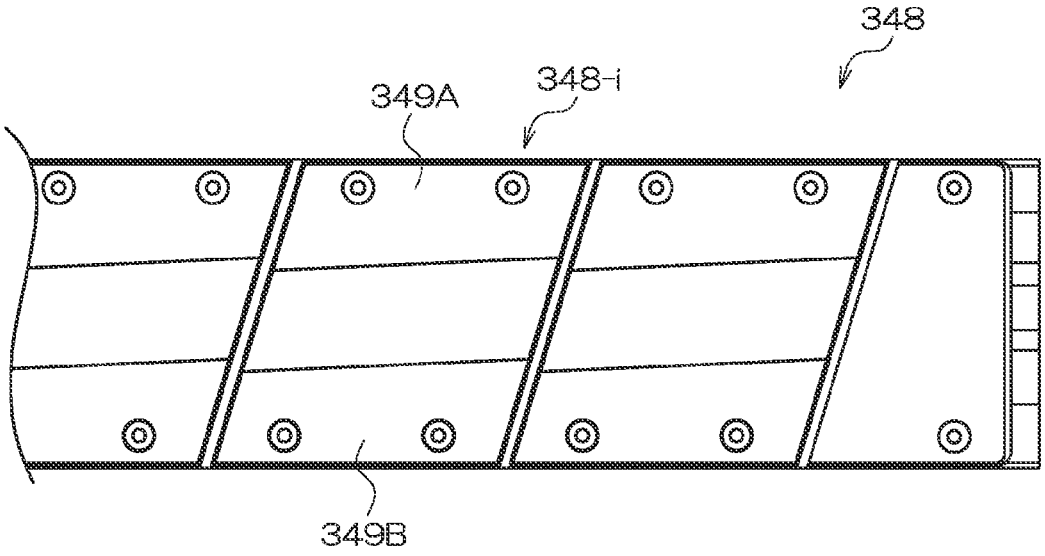
FIG. 16 is a partial enlarged view of FIG. 15.

FIG. 16 is a partial enlarged diagram of the inkjet head 348. As shown in FIG. 16, the sub-heads 348 have a substantially parallelogram-shaped planar shape, and an overlap section is arranged between mutually adjacent sub-heads. The overlap section is a joint section between the sub-heads, in which dots that are mutually adjacent in the alignment direction of the sub-heads 348-*i* (the lateral direction in FIG. 15; the main scanning direction X in FIG. 17) are formed on the recording medium by the nozzles belonging to different sub-heads.

Figure 17:
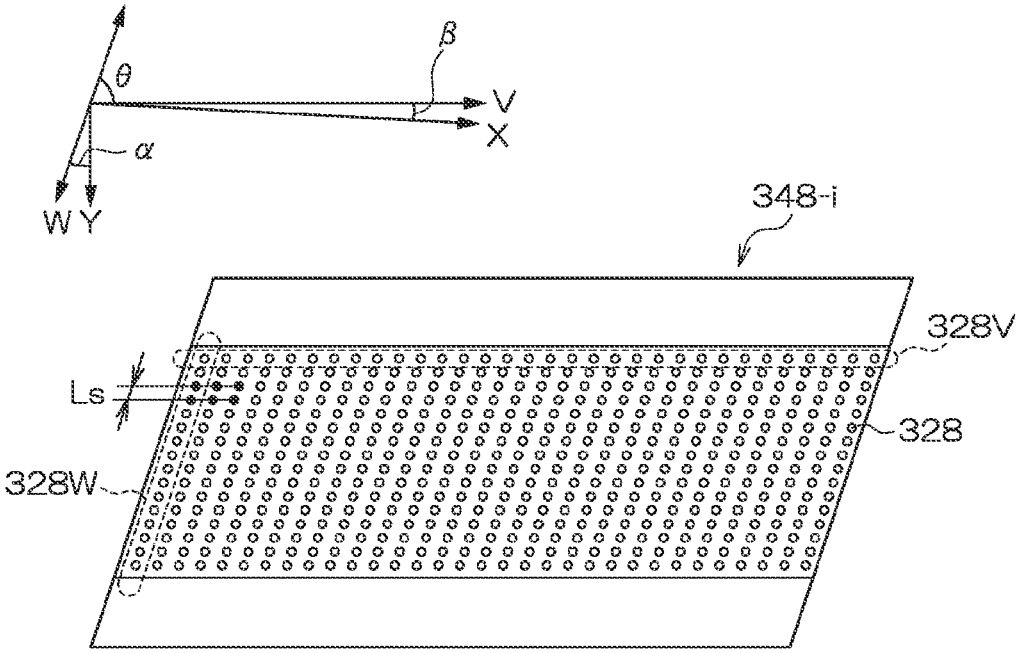
FIG. 17 is a diagram illustrating a nozzle arrangement in the inkjet head shown in FIG. 15.

FIG. 17 is a plan diagram showing a nozzle arrangement in the sub-head 348-*i*. As shown in FIG. 17, each sub-head 348-*i* has a structure in which the nozzles 328 are arranged in a two-dimensional configuration, and the head which includes the sub-heads 348-*i* of this kind is known as a so-called matrix head.

The sub-head 348-*i* shown in FIG. 17 has a structure in which the nozzles 328 are arranged in a column direction W that forms an angle $\alpha$ with respect to the sub-scanning direction Y, and a row direction V that forms an angle $\beta$ with respect to the main scanning direction X, thereby achieving a high density of the effective nozzle arrangement in the main scanning direction X. In FIG. 17, a nozzle group (nozzle row) arranged in the row direction V is denoted with reference numeral 328V, and a nozzle group (nozzle column) arranged in the column direction W is denoted with reference numeral 328W.

In this matrix arrangement, the nozzles 328 can be regarded to be equivalent to those substantially arranged linearly at a fixed pitch $P=Ls/\tan\theta$ along the main scanning direction, where Ls is a distance between the nozzles adjacent in the sub-scanning direction.

In the inkjet head 348 having the structure shown in FIGS. 15 to 17, the head having high-density nozzles according to the present embodiment is achieved by arranging the droplet ejection elements (recording elements) shown in FIG. 2, in a lattice configuration according to the prescribed arrangement pattern following the row direction V, which forms the angle $\beta$ with respect to the main scanning direction X, and the column direction W, which forms the angle $\alpha$ with respect to the sub-scanning direction Y, as shown in FIG. 17.

<Description of Control System>

Figure 18:
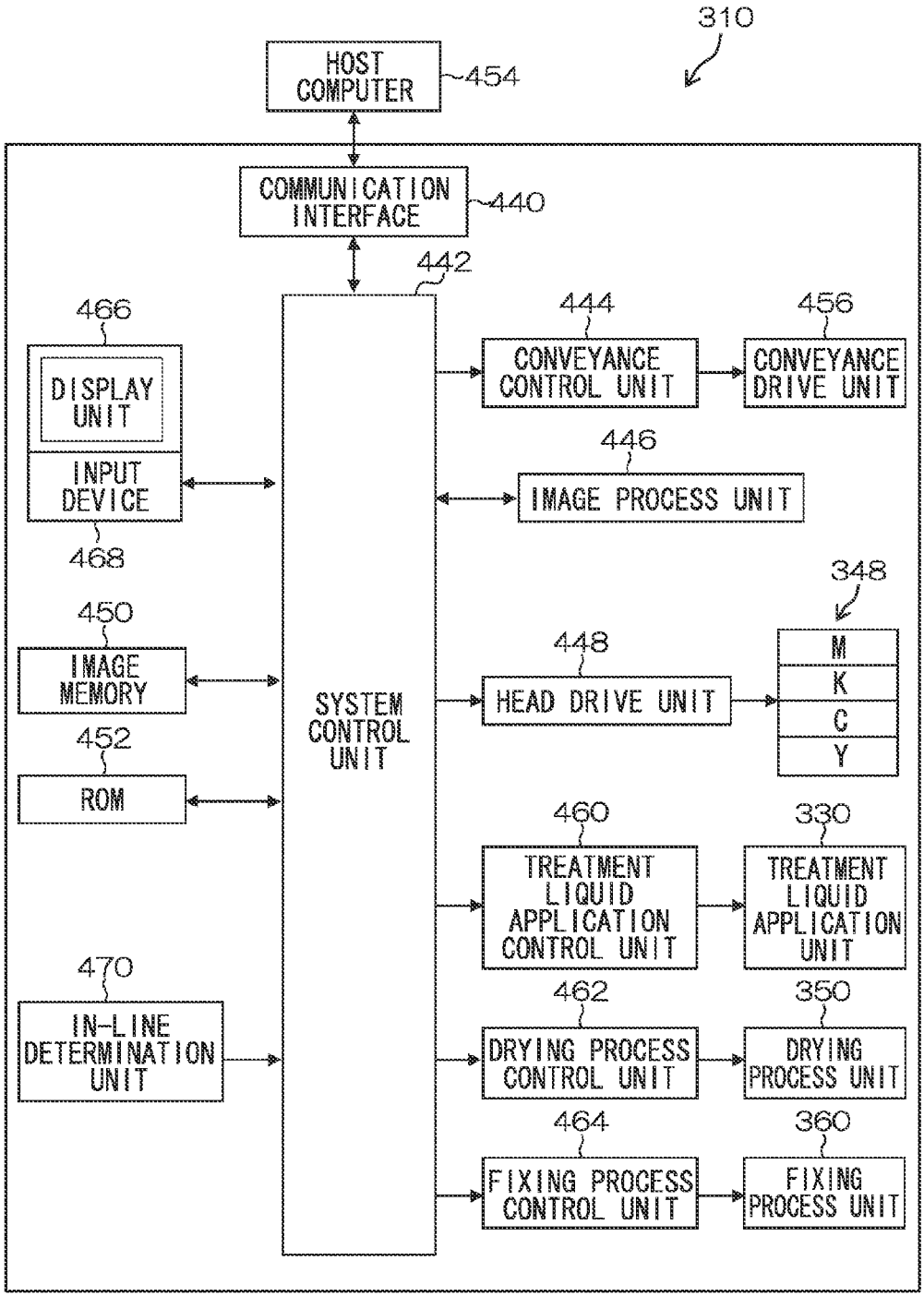
FIG. 18 is a block diagram showing a configuration of a control system of the inkjet recording apparatus shown in FIG. 14.

FIG. 18 is a block diagram showing the system configuration of the inkjet recording apparatus 310. As shown in FIG. 18, the inkjet recording apparatus 310 includes a communication interface 440 and a system control unit 442. The system control unit 442 implements overall control of the various units of the inkjet recording apparatus 310.

The communication interface 440 is an interface unit (image input device) for receiving image data sent from a host computer 454. A serial interface such as USB (Universal Serial Bus), IEEE1394, Ethernet (registered trademark), and wireless network, or a parallel interface such as a Centronics interface may be used as the communication interface 440. A buffer memory (not shown) may be mounted in this portion in order to increase the communication speed.

The system control unit 442 is constituted of a central processing unit (CPU) and peripheral circuits thereof, and the like, and it functions as a control device for controlling the whole of the inkjet recording apparatus 310 in accordance with a prescribed program, as well as a calculation device for performing various calculations. Moreover, the system control unit 442 generates control signals for controlling a conveyance control unit 444, an image process unit 446, a head drive unit 448, and so on, and also functions as a memory controller for an image memory 450, a ROM 452, and the like.

The image process unit 446 is a processing block which carries out prescribed processing on the image data, and includes a processor having an image processing function. The image data sent from the host computer 454 is received by the inkjet recording apparatus 310 through the communication interface 440, and is temporarily stored in the image memory 450. The image memory 450 is a storage device for storing images inputted through the communication interface 440, and data is written and read to and from the image memory 450 through the system control unit 442. The image memory 450 is not limited to a memory composed of semiconductor elements, and a hard disk drive or another magnetic medium may be used.

The program executed by the CPU of the system control unit 442 and the various types of data (including data for deposition to form the test chart, data of abnormal nozzles, and the like) which are required for control procedures are stored in the image memory 450. The image memory 450 may be a non-writeable storage device, or it may be a rewriteable storage device, such as an EEPROM.

A temporary memory (not shown) is used as a temporary storage region for various data such as the image data, and it is also used as a program development region and a calculation work region for the CPU.

The image process unit 446 functions as a signal processing device for performing various treatment processes, corrections, and the like, in accordance with the control implemented by the system control unit 442, in order to generate a signal for controlling droplet ejection from the image data (multiple-value input image data) in the image memory. The signal for controlling droplet ejection (i.e., ink ejection data) generated by the image process unit 446 is sent to the head drive unit 448.

In other words, the image process unit 446 includes functional units such as a density data generation unit, a correction process unit and an ink ejection data generation unit. These functional units can be realized by means of an ASIC, software or a suitable combination of same.

The density data generation unit is a signal processing device which generates initial density data for the respective ink colors, from the input image data, and it carries out density conversion processing (including UCR processing and color conversion) and, where necessary, it also performs pixel number conversion processing. The correction process unit is a processing device which performs density correction calculations using the density correction coefficients, and it carries out the non-uniformity correction processing.

The ink ejection data generation unit is a signal processing device including a halftoning device which converts the corrected image data (density data) generated by the correction process unit into binary or multiple-value dot data, and the ink ejection data generation unit carries out binarization (multiple-value conversion) processing. The halftoning device may employ commonly known methods of various kinds, such as an error diffusion method, a dithering method, a threshold value matrix method, a density pattern method, and the like. The halftoning process generally converts a tonal image data having M values ($M \geq 3$) into tonal image data having two or more values less than M. In the simplest embodiment, the image data is converted into dot image data having 2 values (dot on/dot off); however, in a halftoning process, it is also possible to perform quantization in multiple values which correspond to different types of dot size (for example, three types of dot: a large size dot, a medium size dot and a small size dot).

The image process unit 446 is provided with an image buffer memory (not shown), and image data, parameters, and other data are temporarily stored in the image buffer memory when image data is processed in the image process unit 446. It is possible that the image buffer memory is attached to the image process unit 446, or the image memory may also serve as the image buffer memory. Also possible is a mode in which the image process unit 446 and the system control unit 442 are integrated to form a single processor.

The ink ejection data generated by the image process unit 446 (the ink ejection data generation unit) is supplied to the head drive unit 448, which controls the ink ejection operation of the inkjet heads 348 accordingly.

The head drive unit 448 functions as a device which controls the ejection operation of the inkjet heads 348, and includes a drive waveform generation unit, which generates drive signal waveforms in order to drive the piezoelectric actuators 16 (see FIG. 1) corresponding to the nozzles 328 of the inkjet heads 348. The signal outputted from the drive waveform generation unit can be digital waveform data, or it can be an analog voltage signal. The drive waveform generation unit serves as the waveform generation unit 18 in FIG. 1.

To give a general description of the sequence of processing from image input to print output, image data to be printed (original image data) is inputted from an external source through the communication interface 440, and is accumulated in the image memory. At this stage, multiple-value RGB image data is stored in the image memory, for example.

In this inkjet recording apparatus 310, an image which appears to have a continuous tonal graduation to the human eye is formed by changing the deposition density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory is sent through the system control unit 442 to the image process unit 446, in which the image data is subjected to processing in the density data generation unit, the correction process unit and the ink ejection data generation unit, and thereby converted to the dot data for each ink color.

In other words, the image process unit 446 performs processing for converting the input RGB image data into dot data for the four colors of M, K, C and Y. The dot data thus generated by the image process unit 446 is stored in the image buffer memory. This dot data of the respective colors is converted into MKCY droplet ejection data for ejecting ink from the nozzles of the inkjet heads 348, thereby establishing the ink ejection data (including the driving timings of the respective nozzles and the dot sizes (ejection volumes) at the respective driving timings of the nozzles) to be printed.

The processing in the image process unit 446 corresponds to the processing in the waveform selecting unit 20 and the nozzle selecting unit 22 shown in FIG. 1. In other words, the waveform selecting unit 20 and the nozzle selecting unit 22 shown in FIG. 1 perform a part of processing in the image process unit 446 in FIG. 18.

The head drive unit 448 outputs drive signals for driving the actuators 16 corresponding to the nozzles 328 of the inkjet heads 348 in accordance with the print contents, on the basis of the ink ejection data and the drive signals (drive waveforms). A feedback control system for maintaining constant drive conditions in the inkjet heads 348 may be included in the head drive unit 448. The head drive unit 448 shown in FIG. 18 corresponds to the head drive unit 24 shown in FIG. 1.

By supplying the drive signals outputted by the head drive unit 448 to the inkjet heads 348 in this way, ink is ejected from the corresponding nozzles 328. By controlling ink ejection from the inkjet heads 348 in synchronization with the conveyance speed of the recording medium 314, an image is formed on the recording medium 314.

As described above, the ejection volumes and the ejection timings of the ink droplets from the respective nozzles are controlled through the head drive unit 448, on the basis of the ink ejection data generated by implementing prescribed signal processing in the image process unit 446, and the drive signal waveform. By this means, prescribed dot size and dot positions can be achieved.

An in-line determination unit 470 shown in FIG. 18 is a functional block which reads in a nozzle determination pattern, processes the read data, carries out an abnormal nozzle judgment process, and supplies the information relating to abnormal nozzles to the system control unit 442. The in-line determination unit 470 includes the in-line sensor 382 shown in FIG. 14.

The system control unit 442 implements various corrections with respect to the inkjet heads 348, on the basis of the information including the information concerning the abnormal nozzles obtained from the in-line determination unit 470, according to requirements, and it implements control for carrying out cleaning operations (nozzle restoring operations), such as preliminary ejection, suctioning, or wiping, as and when necessary.

The inkjet recording apparatus 310 is provided with a maintenance processing unit (not shown) serving as a device which implements cleaning operations, and the maintenance processing unit includes members used to head maintenance, such as an ink receptacle, a suction cap, a suction pump, a wiper blade, and the like.

The inkjet recording apparatus 310 is an operating unit serving as a user interface constituted of an input device 468 through which an operator (user) can make various inputs, and a display unit 466. The input device 468 can employ various formats, such as a keyboard, mouse, touch panel, buttons, or the like. The operator is able to input print conditions, select image quality modes, input and edit additional information, search for information, and the like, by operating the input device 468, and is able to check various information, such as the input contents, search results, and the like, through a display on the display unit 466. The display unit 466 also functions as a warning notification device which displays a warning message, or the like.

The inkjet recording apparatus 310 according to the present embodiment has a plurality of image quality modes, and the image quality mode is set either by a selection operation performed by the user or by automatic selection by a program. The criteria for judging an abnormal nozzle are changed in accordance with the output image quality level which is required by the image quality mode that has been set. If the required image quality is high, then the judgment criteria are set to be more severe.

Information relating to the printing conditions and the abnormal nozzle judgment criteria for each image quality mode is stored in the image memory 450.

The inkjet recording apparatus 310 described in the present embodiment is composed so as to perform image recording using small size dots in high-quality mode and to perform image recording using medium size dots and large size dots in normal mode or high-speed recording mode. More specifically, in high-quality image formation, small size dots are arranged at high density, and therefore the deformation of the dot shape due to the occurrence of satellite presents a problem. Deformation of the dots due to the occurrence of satellite is avoided by suppressing the occurrence of satellite after ejection, and hence dots having high definition are formed.

On the other hand, in the normal mode or the high-speed mode, continuous ejection is performed with a short cycle using medium size dots or large size dots, and therefore the issue of vibration of the meniscus after ejection becomes a problem. In the high-speed (normal) mode, the vibration of the meniscus after ejection is rapidly constricted by the action of the meniscus stabilizing waveform, and problems such as nozzle omissions in the event of continuous ejection at a short cycle are prevented.

As modification examples of the present embodiment, it is possible to adopt a mode in which the standard drive waveform is modified so as to apply a satellite suppressing waveform after the ejection waveform corresponding to a medium size dot, in such a manner that the occurrence of satellite is suppressed in ejection for forming the medium size dot.

Example of Application to Other Apparatuses

In the embodiments described above, application to the inkjet recording apparatus for graphic printing has been described, but the scope of application of the present invention is not to limited to this. For example, the present invention can also be applied widely to inkjet systems which obtain various shapes or patterns using liquid function material, such as a wire printing apparatus, which forms an image of a wire pattern for an electronic circuit, manufacturing apparatuses for various devices, a resist printing apparatus, which uses resin liquid as a functional liquid for ejection, a color filter manufacturing apparatus, a fine structure forming apparatus for forming a fine structure using a material for material deposition, or the like.

APPENDIX

As has become evident from the detailed description of the embodiments given above, the present specification includes disclosure of various technical ideas as follows.

For example, an inkjet ejection apparatus can include: an inkjet head which includes: a nozzle through which droplets of liquid are ejected to a recording medium; a liquid chamber which contains the liquid and is connected to the nozzle; and a piezoelectric actuator which applies pressure to the liquid in the liquid chamber when a drive signal is applied to the piezoelectric actuator; and a drive device which drives the inkjet head by supplying the drive signal so as to eject droplets of the liquid to selectively form dots of at least two different sizes on the recording medium, wherein the drive device includes: a waveform generating device which generates a standard drive waveform, the standard drive waveform containing, in one ejection cycle: a first ejection waveform group which includes one or more of ejection waveforms capable of causing the liquid to be ejected from the nozzle to form one dot of a maximum size on the recording medium; a first non-ejection waveform which is arranged after the first ejection waveform group by a first time interval from a start of a last one of the one or more of ejection waveforms of the first ejection waveform group until a start of the first non-ejection waveform, the first non-ejection waveform not causing the liquid to be ejected from the nozzle, the first non-ejection waveform being applied in order to suppress meniscus vibration after ejection; a second ejection waveform group which includes one or more of ejection waveforms capable of causing the liquid to be ejected from the nozzle to form at least a dot of a minimum size on the recording medium; and a second non-ejection waveform which is arranged after the second ejection waveform group by a second time interval from a start of a last one of the one or more of ejection waveforms of the second ejection waveform group until a start of the second non-ejection waveform, the second non-ejection waveform not causing the liquid to be ejected from the nozzle, the second non-ejection waveform being applied in order to suppress an occurrence of satellite after ejection; a waveform selecting device which selects at least one of the ejection waveforms from one of the first and second ejection waveform groups in accordance with ejection data, the waveform selecting device further selecting the first non-ejection waveform when the selected at least one of the ejection waveforms belongs to the first ejection waveform group, the waveform selecting device further selecting the second non-ejection waveform when the selected at least one of the ejection waveforms belongs to the second ejection waveform group; and a drive signal generating device which generates the drive signal having the selected at least one of the ejection waveforms and the selected one of the first and second non-ejection waveforms.

According to this aspect, either meniscus stabilization after ejection or suppression of the occurrence of satellite after ejection is selectively performed by selecting either a combination of the first ejection waveform group and the first non-ejection waveform, or a combination of the second ejection waveform group and the second non-ejection waveform, in accordance with the ejection data, from the standard drive waveform which includes the first ejection waveform group containing the at least one ejection waveform capable of forming a dot of the maximum size, the first non-ejection waveform for suppressing meniscus vibration after ejection, the second ejection waveform group containing the at least one ejection waveform capable of forming at least a dot of the minimum size, and the second non-ejection waveform for suppressing the occurrence of satellite after ejection. Therefore, desirable droplet ejection is performed in which either the occurrence of satellite is suppressed or vibration of the meniscus is suppressed, in accordance with the ejection conditions.

Moreover, since the drive method is employed in which the waveform elements required for droplet ejection are extracted from the standard elements included in the standard drive waveform, and the unwanted waveform elements are removed, then it is possible to achieve a smaller-scale composition of the drive device.

The plurality of ejection waveforms contained in the first and second ejection waveform groups can have the same shape or different shapes (shapes in which parameters such as the amplitude, width, gradient, and the like, are altered appropriately). For example, a possible mode is one where, if dots of three different sizes, large, medium and small, are formed, then ejection waveforms corresponding to the respective sizes are provided and the first ejection waveform group is constituted of an ejection waveform for the large size and an ejection waveform for the medium size, and the second ejection waveform group is constituted of an ejection waveform for the small size.

Furthermore, each of the first and second non-ejection waveforms can be constituted of a non-ejection waveform group containing a plurality of waveform elements.

In a mode where a plurality of nozzles are provided, desirably, a nozzle selecting device is provided to select a nozzle from which droplet ejection is to be performed, a common drive signal is supplied for each of the nozzles, and a desired drive signal is applied only to the nozzle selected by the nozzle selecting device.

Preferably, the first ejection waveform group includes a plurality of the ejection waveforms which are arranged at prescribed intervals and are of a number not less than a number of ejection actions necessary to form a dot of the maximum size; and the second ejection waveform group includes one or more of the ejection waveforms which are capable of forming a dot of the minimum size and are of a number less than the number of the ejection waveforms included in the first ejection waveform group.

According to this mode, it is possible to represent tones by means of the dot size, by suitably combining a plurality of ejection waveforms.

Preferably, the first non-ejection waveform is applied in a substantially opposite phase to the meniscus vibration after ejection; and the second non-ejection waveform is applied in a substantially same phase as the meniscus vibration after ejection.

In this mode, when the first ejection waveform group is selected, the number of ejection actions for forming one dot is greater (i.e., the total ejected droplet volume is greater) than when the second ejection waveform group is selected, and it is necessary to suppress vibration of the meniscus after ejection. On the other hand, when the second ejection waveform group is selected, the number of ejection actions for forming one dot is smaller (the total ejected droplet volume is smaller) than when the first ejection waveform group is selected, and it is necessary to suppress the occurrence of satellite after ejection.

Preferably, the waveform selecting device selects the at least one of the ejection waveforms from the first ejection waveform group when forming a dot of the maximum size, and selects the at least one of the ejection waveforms from the second waveform group when forming a dot of the minimum size.

According to this mode, desirably, a mode selecting device for switching between a high-speed ejection mode and a high-definition ejection mode is provided, and the at least one of the ejection waveforms is selected from the first ejection waveform group when the high-speed ejection mode is selected, whereas the at least one of the ejection waveforms is selected from the second ejection waveform group when the high-definition mode is selected. According to this mode, dot omissions are avoided by suppressing vibration of the meniscus in the high-speed ejection mode, and deterioration of ejection quality due to the occurrence of satellite is avoided by suppressing the occurrence of satellite in the high-definition mode.

Preferably, the second time interval is expressed by $Tc \times n$, where Tc is a Helmholtz period determined by a structure of the inkjet head, and n is a positive integer.

According to this mode, since the second non-ejection waveform which suppresses the occurrence of satellite after ejection is applied in substantially the same phase as the vibration of the meniscus after ejection, the occurrence of satellite after ejection is effectively prevented.

Preferably, the first time interval is expressed by $3 \times t_B \times n/2$, where $t_B$ is the second time interval, and n is a positive integer.

According to this mode, it is possible to make the phase of the vibration of the meniscus after two or more consecutive ejections for forming one dot, and the phase of the first non-ejection waveform substantially opposite phases.

Preferably, the first time interval is expressed by $Tc \times (2n-1)/2$, where Tc is a Helmholtz period determined by a structure of the inkjet head, and n is a positive integer.

According to this mode, the first non-ejection waveform which stabilizes the meniscus after two or more consecutive ejections for forming one dot is of substantially opposite phase to the vibration of the meniscus after ejection, and it is possible to effectively stabilize the vibration of the meniscus after ejection.

Preferably, the first time interval is a positive-integer multiple of the second time interval; and a time interval from the start of the first non-ejection waveform until a point in a falling portion of the first non-ejection waveform is a positive-integer multiple of the second time interval.

The rising portion of the first non-ejection waveform according to this mode operates the piezoelectric actuator in the direction which pushes the meniscus toward the outside of the nozzle. On the other hand, the vibration of the meniscus from the start of the last ejection waveform of the first ejection waveform group until a time which is a positive-integer multiple of the second time interval acts in the direction which pulls the meniscus inside the nozzle. Consequently, it is possible to make the meniscus and the falling portion of the first non-ejection waveform have opposite phases, and therefore vibration of the meniscus can be effectively suppressed.

Preferably, a time interval from the start of the last one of the one or more of ejection waveforms of the first ejection waveform group until a point in a rising portion of the first non-ejection waveform is a positive-integer multiple of the second time interval.

According to this mode, it is possible to make the meniscus and the rising portion of the first non-ejection waveform have opposite phases, and therefore vibration of the meniscus can be effectively suppressed. The rising portion of the first non-ejection waveform according to this mode operates the piezoelectric actuator in the direction which pulls the meniscus toward the inside of the nozzle.

Preferably, each of the ejection waveforms and the second non-ejection waveform has one of a substantially rectangular shape, a substantially trapezoid shape and a substantially triangular shape; and a width of the second non-ejection waveform is substantially equal to a width of each of the ejection waveforms.

In this mode, if the waveform is substantially trapezoid shaped or substantially triangular shaped, the width of waveform means the time period from the center of the rising portion of the waveform until the center of the falling portion of the waveform, whereas if the waveform is a substantially rectangular shaped, the width of waveform means the time during which the waveform has a prescribed voltage portion.

In this mode, desirably, the width of the ejection waveform and the width of the second non-ejection waveform are substantially ½ of the Helmholtz period.

Preferably, the first non-ejection waveform has one of a substantially rectangular shape, a substantially trapezoid shape and a substantially triangular shape; and a width of the first non-ejection waveform is substantially equal to a width of each of the ejection waveforms.

In this mode, desirably, the width of the first non-ejection waveform is the Helmholtz period.

Preferably, when forming a dot of a medium size between the maximum size and the minimum size, the waveform selecting device selects a part of the ejection waveforms belonging to the first ejection waveform group.

According to this mode, when forming a dot of the medium size, vibration of the meniscus after ejection is suppressed and even if droplets are consecutively ejected, a preceding ejection action does not affect a subsequent ejection action.

Preferably, the standard drive waveform has a structure in which the first ejection waveform group, the first non-ejection waveform, the second ejection waveform group and the second non-ejection waveform are arranged in this order.

According to this mode, it is possible further to shorten the timing difference between the ejection timing in a case of forming a dot of the maximum size and the ejection timing in a case of forming a dot of the minimum size. The "ejection timing" in a case where one dot is formed by ejecting a plurality of droplets is the ejection timing of the droplet that is ejected last in the plurality of droplets.

In this mode, when all or a part of the ejection waveforms of the first ejection waveform group are selected, then it is possible to perform ejection for forming a dot of the maximum size, and when all or a part of the ejection waveforms of the second ejection waveform group are selected, it is possible to perform ejection for forming a dot of the minimum size. If forming a dot of a medium size between the maximum size and the minimum size, a part of the ejection waveforms in the first ejection waveform group is selected if there is a need for stabilization of the meniscus after ejection, whereas a part of the ejection waveforms in the second ejection waveform group is selected if there is a need for suppression of satellite after ejection.

It is also possible that the standard drive waveform has a structure in which the second ejection waveform group, the second non-ejection waveform, the first ejection waveform group and the first non-ejection waveform are arranged in this order.

In this mode, preferably, when forming a dot of the maximum size, the waveform selecting device selects the at least one of the ejection waveforms from the first ejection waveform group, further selects the first non-ejection waveform, and also selects the second non-ejection waveform.

According to this mode, when forming a dot of the maximum size, the liquid inside the nozzle is churned by vibrating the meniscus before ejection and therefore the volume of the ejected droplet is stabilized.

Preferably, the waveform selecting device selects at least one of the first and second non-ejection waveforms for an idle nozzle which is not caused to eject the liquid; and the drive signal generating device generates an idle drive signal applied to the piezoelectric actuator corresponding to the idle nozzle, the idle drive signal having the at least one of the first and second non-ejection waveforms selected by the waveform selecting device for the idle nozzle.

According to this mode, initial ejection characteristics after an idle period are stabilized and so-called nozzle omissions are prevented.

Moreover, for example, an inkjet ejection method for an inkjet head which includes: a nozzle through which droplets of liquid are ejected to a recording medium; a liquid chamber which contains the liquid and is connected to the nozzle; and a piezoelectric actuator which applies pressure to the liquid in the liquid chamber when a drive signal is applied to the piezoelectric actuator, the method can include the step of: driving the inkjet head by supplying the drive signal so as to eject droplets of the liquid to selectively form dots of at least two different sizes on the recording medium, wherein the driving step includes the steps of: generating a standard drive waveform, the standard drive waveform containing, in one ejection cycle: a first ejection waveform group which includes one or more of ejection waveforms capable of causing the liquid to be ejected from the nozzle to form one dot of a maximum size on the recording medium; a first non-ejection waveform which is arranged after the first ejection waveform group by a first time interval from a start of a last one of the one or more of ejection waveforms of the first ejection waveform group until a start of the first non-ejection waveform, the first non-ejection waveform not causing the liquid to be ejected from the nozzle, the first non-ejection waveform being applied in order to suppress meniscus vibration after ejection; a second ejection waveform group which includes one or more of ejection waveforms capable of causing the liquid to be ejected from the nozzle to form at least a dot of a minimum size on the recording medium; and a second non-ejection waveform which is arranged after the second ejection waveform group by a second time interval from a start of a last one of the one or more of ejection waveforms of the second ejection waveform group until a start of the second non-ejection waveform, the second non-ejection waveform not causing the liquid to be ejected from the nozzle, the second non-ejection waveform being applied in order to suppress an occurrence of satellite after ejection; selecting at least one of the ejection waveforms from one of the first and second ejection waveform groups in accordance with ejection data, further selecting the first non-ejection waveform when the selected at least one of the ejection waveforms belongs to the first ejection waveform group, and further selecting the second non-ejection waveform when the selected at least one of the to ejection waveforms belongs to the second ejection waveform group; and generating the drive signal having the selected at least one of the ejection waveforms and the selected one of the first and second non-ejection waveforms.

Furthermore, for example, an inkjet recording apparatus can include: an inkjet head which includes: a nozzle through which droplets of liquid are ejected to a recording medium; a liquid chamber which contains the liquid and is connected to the nozzle; and a piezoelectric actuator which applies pressure to the liquid in the liquid chamber when a drive signal is applied to the piezoelectric actuator; a movement device which moves the inkjet head and the recording medium relatively to each other; and a drive device which drives the inkjet head by supplying the drive signal so as to eject droplets of the liquid to selectively form dots of at least two different sizes on the recording medium, wherein the drive device includes: a waveform generating device which generates a standard drive waveform, the standard drive waveform containing, in one ejection cycle: a first ejection waveform group which includes one or more of ejection waveforms capable of causing the liquid to be ejected from the nozzle to form one dot of a maximum size on the recording medium; a first non-ejection waveform which is arranged after the first ejection waveform group by a first time interval from a start of a last one of the one or more of ejection waveforms of the first ejection waveform group until a start of the first non-ejection waveform, the first non-ejection waveform not causing the liquid to be ejected from the nozzle, the first non-ejection waveform being applied in order to suppress meniscus vibration after ejection; a second ejection waveform group which includes one or more of ejection waveforms capable of causing the liquid to be ejected from the nozzle to form at least a dot of a minimum size on the recording medium; and a second non-ejection waveform which is arranged after the second ejection waveform group by a second time interval from a start of a last one of the one or more of ejection waveforms of the second ejection waveform group until a start of the second non-ejection waveform, the second non-ejection waveform not causing the liquid to be ejected from the nozzle, the second non-ejection waveform being applied in order to suppress an occurrence of satellite after ejection; a waveform selecting device which selects at least one of the ejection waveforms from one of the first and second ejection waveform groups in accordance with ejection data, the waveform selecting device further selecting the first non-ejection waveform when the selected at least one of the ejection waveforms belongs to the first ejection waveform group, the waveform selecting device further selecting the second non-ejection waveform when the to selected at least one of the ejection waveforms belongs to the second ejection waveform group; and a drive signal generating device which generates the drive signal having the selected at least one of the ejection waveforms and the selected one of the first and second non-ejection waveforms.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet ejection apparatus comprising:

an inkjet head which includes: a nozzle through which droplets of liquid are ejected to a recording medium; a liquid chamber which contains the liquid and is connected to the nozzle; and a piezoelectric actuator which applies pressure to the liquid in the liquid chamber when a drive signal is applied to the piezoelectric actuator; and a drive device which drives the inkjet head by supplying the drive signal so as to eject droplets of the liquid to selectively form dots of at least two different sizes on the recording medium, wherein the drive device includes:

a waveform generating device which generates a standard drive waveform, the standard drive waveform containing, in one ejection cycle to form only one dot by the nozzle:

a first ejection waveform group which includes one or more of ejection waveforms capable of causing the liquid to be ejected from the nozzle to form one dot of a maximum size on the recording medium;

a first non-ejection waveform which is arranged after the first ejection waveform group by a first time interval from a start of a last one of the one or more of ejection waveforms of the first ejection waveform group until a start of the first non-ejection waveform, the first non-ejection waveform not causing the liquid to be ejected from the nozzle, the first non-ejection waveform being applied in order to suppress meniscus vibration after ejection;

a second ejection waveform group which includes one or more of ejection waveforms capable of causing the liquid to be ejected from the nozzle to form at least a dot of a minimum size on the recording medium; and a second non-ejection waveform which is arranged after the second ejection waveform group by a second time interval from a start of a last one of the one or more of ejection waveforms of the second ejection waveform group until a start of the second non-ejection waveform, the second non-ejection waveform not causing the liquid to be ejected from the nozzle, the second non-ejection waveform being applied in order to suppress an occurrence of satellite after ejection;

a waveform selecting device which selects from the standard drive waveform at least one of the ejection waveforms from one of the first and second ejection waveform groups in accordance with ejection data, the waveform selecting device further selecting the first non-ejection waveform when the selected at least one of the ejection waveforms belongs to the first ejection waveform group, the waveform selecting device further selecting the second non-ejection waveform when the selected at least one of the ejection waveforms belongs to the second ejection waveform group; and a drive signal generating device which generates the drive signal having the selected at least one of the ejection waveforms and the selected one of the first and second non-ejection waveforms.

2. The inkjet ejection apparatus as defined in claim 1, wherein:

the first ejection waveform group includes a plurality of the ejection waveforms which are arranged at prescribed intervals and are of a number not less than a number of ejection actions necessary to form a dot of the maximum size; and the second ejection waveform group includes one or more of the ejection waveforms which are capable of forming a dot of the minimum size and are of a number less than the number of the ejection waveforms included in the first ejection waveform group.

3. The inkjet ejection apparatus as defined in claim 2, wherein:

the first non-ejection waveform is applied in a substantially opposite phase to the meniscus vibration after ejection; and the second non-ejection waveform is applied in a substantially same phase as the meniscus vibration after ejection.

4. The inkjet ejection apparatus as defined in claim 1, wherein the waveform selecting device selects the at least one of the ejection waveforms from the first ejection waveform group when forming a dot of the maximum size, and selects the at least one of the ejection waveforms from the second waveform group when forming a dot of the minimum size.

5. The inkjet ejection apparatus as defined in claim 1, wherein the second time interval is expressed by Tc×n, where Tc is a Helmholtz period determined by a structure of the inkjet head, and n is a positive integer.

6. The inkjet ejection apparatus as defined in claim 5, wherein the first time interval is expressed by $3\times t_B\times n/2$, where $t_B$ is the second time interval, and n is a positive integer.

7. The inkjet ejection apparatus as defined in claim 1, wherein the first time interval is expressed by $Tc\times(2n-1)/2$, where Tc is a Helmholtz period determined by a structure of the inkjet head, and n is a positive integer.

8. The inkjet ejection apparatus as defined in claim 1, wherein:

the first time interval is a positive-integer multiple of the second time interval; and a time interval from the start of the first non-ejection waveform until a point in a falling portion of the first non-ejection waveform is a positive-integer multiple of the second time interval.

9. The inkjet ejection apparatus as defined in claim 1, wherein a time interval from the start of the last one of the one or more of ejection waveforms of the first ejection waveform group until a point in a rising portion of the first non-ejection waveform is a positive-integer multiple of the second time interval.

10. The inkjet ejection apparatus as defined in claim 1, wherein:

each of the ejection waveforms and the second non-ejection waveform has one of a substantially rectangular shape, a substantially trapezoid shape and a substantially triangular shape; and a width of the second non-ejection waveform is substantially equal to a width of each of the ejection waveforms.

11. The inkjet ejection apparatus as defined in claim 1, wherein:

the first non-ejection waveform has one of a substantially rectangular shape, a substantially trapezoid shape and a substantially triangular shape; and a width of the first non-ejection waveform is substantially equal to a width of each of the ejection waveforms.

12. The inkjet ejection apparatus as defined in claim 1, wherein when forming a dot of a medium size between the maximum size and the minimum size, the waveform selecting device selects a part of the ejection waveforms belonging to the first ejection waveform group.

13. The inkjet ejection apparatus as defined in claim 1, wherein the standard drive waveform has a structure in which the first ejection waveform group, the first non-ejection waveform, the second ejection waveform group and the second non-ejection waveform are arranged in this order.

14. The inkjet ejection apparatus as defined in claim 1, wherein the standard drive waveform has a structure in which the second ejection waveform group, the second non-ejection waveform, the first ejection waveform group and the first non-ejection waveform are arranged in this order.

15. The inkjet ejection apparatus as defined in claim 14, wherein when forming a dot of the maximum size, the waveform selecting device selects the at least one of the ejection waveforms from the first ejection waveform group, further selects the first non-ejection waveform, and also selects the second non-ejection waveform.

16. The inkjet ejection apparatus as defined in claim 1, wherein:

the waveform selecting device selects at least one of the first and second non-ejection waveforms for an idle nozzle which is not caused to eject the liquid; and the drive signal generating device generates an idle drive signal applied to the piezoelectric actuator corresponding to the idle nozzle, the idle drive signal having the at least one of the first and second non-ejection waveforms selected by the waveform selecting device for the idle nozzle.

17. An inkjet ejection method for an inkjet head which includes: a nozzle through which droplets of liquid are ejected to a recording medium; a liquid chamber which contains the liquid and is connected to the nozzle; and a piezoelectric actuator which applies pressure to the liquid in the liquid chamber when a drive signal is applied to the piezoelectric actuator, the method comprising the step of:

driving the inkjet head by supplying the drive signal so as to eject droplets of the liquid to selectively form dots of at least two different sizes on the recording medium, wherein the driving step includes the steps of:

generating a standard drive waveform, the standard drive waveform containing, in one ejection cycle to form only one dot by the nozzle:

a first ejection waveform group which includes one or more of ejection waveforms capable of causing the liquid to be ejected from the nozzle to form one dot of a maximum size on the recording medium;

a first non-ejection waveform which is arranged after the first ejection waveform group by a first time interval from a start of a last one of the one or more of ejection waveforms of the first ejection waveform group until a start of the first non-ejection waveform, the first non-ejection waveform not causing the liquid to be ejected from the nozzle, the first non-ejection waveform being applied in order to suppress meniscus vibration after ejection;

a second ejection waveform group which includes one or more of ejection waveforms capable of causing the liquid to be ejected from the nozzle to form at least a dot of a minimum size on the recording medium; and a second non-ejection waveform which is arranged after the second ejection waveform group by a second time interval from a start of a last one of the one or more of ejection waveforms of the second ejection waveform group until a start of the second non-ejection waveform, the second non-ejection waveform not causing the liquid to be ejected from the nozzle, the second non-ejection waveform being applied in order to suppress an occurrence of satellite after ejection;

selecting from the standard drive waveform at least one of the ejection waveforms from one of the first and second ejection waveform groups in accordance with ejection data, further selecting the first non-ejection waveform when the selected at least one of the ejection waveforms belongs to the first ejection waveform group, and further selecting the second non-ejection waveform when the selected at least one of the ejection waveforms belongs to the second ejection waveform group; and generating the drive signal having the selected at least one of the ejection waveforms and the selected one of the first and second non-ejection waveforms.

18. An inkjet recording apparatus, comprising:

an inkjet head which includes: a nozzle through which droplets of liquid are ejected to a recording medium; a liquid chamber which contains the liquid and is connected to the nozzle; and a piezoelectric actuator which applies pressure to the liquid in the liquid chamber when a drive signal is applied to the piezoelectric actuator;

a movement device which moves the inkjet head and the recording medium relatively to each other; and a drive device which drives the inkjet head by supplying the drive signal so as to eject droplets of the liquid to selectively form dots of at least two different sizes on the recording medium, wherein the drive device includes:

a waveform generating device which generates a standard drive waveform, the standard drive waveform containing, in one ejection cycle to form only one dot by the nozzle:

a first ejection waveform group which includes one or more of ejection waveforms capable of causing the liquid to be ejected from the nozzle to form one dot of a maximum size on the recording medium;

a first non-ejection waveform which is arranged after the first ejection waveform group by a first time interval from a start of a last one of the one or more of ejection waveforms of the first ejection waveform group until a start of the first non-ejection waveform, the first non-ejection waveform not causing the liquid to be ejected from the nozzle, the first non-ejection waveform being applied in order to suppress meniscus vibration after ejection;

a second ejection waveform group which includes one or more of ejection waveforms capable of causing the liquid to be ejected from the nozzle to form at least a dot of a minimum size on the recording medium; and a second non-ejection waveform which is arranged after the second ejection waveform group by a second time interval from a start of a last one of the one or more of ejection waveforms of the second ejection waveform group until a start of the second non-ejection waveform, the second non-ejection waveform not causing the liquid to be ejected from the nozzle, the second non-ejection waveform being applied in order to suppress an occurrence of satellite after ejection;

a waveform selecting device which selects from the standard drive waveform at least one of the ejection waveforms from one of the first and second ejection waveform groups in accordance with ejection data, the waveform selecting device further selecting the first non-ejection waveform when the selected at least one of the ejection waveforms belongs to the first ejection waveform group, the waveform selecting device further selecting the second non-ejection waveform when the selected at least one of the ejection waveforms belongs to the second ejection waveform group; and a drive signal generating device which generates the drive signal having the selected at least one of the ejection waveforms and the selected one of the first and second non-ejection waveforms.

* * * * *